US007866117B1

(12) United States Patent
Saebi

(10) Patent No.: US 7,866,117 B1
(45) Date of Patent: Jan. 11, 2011

(54) COMPOSITE BOX BUILDING AND THE METHOD OF CONSTRUCTION

(76) Inventor: Nasser Saebi, 18231 N. 66$^{th}$ La., Glendale, AZ (US) 85308

( * ) Notice: Subject to any disclaimer, the term of this patent is extended or adjusted under 35 U.S.C. 154(b) by 0 days.

(21) Appl. No.: 12/455,856

(22) Filed: Jun. 6, 2009

Related U.S. Application Data

(63) Continuation of application No. 10/897,657, filed on Jul. 21, 2004, now abandoned.

(51) Int. Cl.
*E04B 1/00* (2006.01)

(52) U.S. Cl. ..... 52/746.1; 52/34; 52/741.1; 52/309.17; 52/309.1; 52/309.3

(58) Field of Classification Search ..... 52/34, 52/304.12, 309.17, 741.41, 747.1, 79.14, 52/309.1, 309.3, 730.4, 732.1, 762, 763, 52/729.2, 726.1–726.5
See application file for complete search history.

(56) References Cited

U.S. PATENT DOCUMENTS

| | | | | | |
|---|---|---|---|---|---|
| 2,948,995 | A * | 8/1960 | Cogan | 52/259 |
| 3,377,755 | A * | 4/1968 | Meuli et al. | 52/79.13 |
| 3,405,903 | A * | 10/1968 | Sullivan | 249/28 |
| 3,410,044 | A * | 11/1968 | Moog | 52/309.12 |
| 3,435,580 | A * | 4/1969 | Johnson et al. | 52/405.3 |
| 3,443,347 | A * | 5/1969 | Varnell et al. | 52/223.3 |
| 3,510,997 | A * | 5/1970 | Ratych | 52/79.2 |
| 3,861,093 | A * | 1/1975 | Robinson | 52/79.14 |
| 3,932,969 | A * | 1/1976 | Matras | 52/86 |
| 4,453,359 | A * | 6/1984 | Robinson | 52/389 |
| 4,532,745 | A * | 8/1985 | Kinard | 52/251 |
| 5,354,414 | A * | 10/1994 | Feygin | 216/34 |
| 5,419,200 | A * | 5/1995 | Burns et al. | 73/760 |
| 5,514,232 | A * | 5/1996 | Burns | 156/64 |
| 5,637,175 | A * | 6/1997 | Feygin et al. | 156/264 |
| 5,684,713 | A * | 11/1997 | Asada et al. | 716/19 |
| 5,697,189 | A * | 12/1997 | Miller et al. | 52/79.9 |
| 5,771,649 | A * | 6/1998 | Zweig | 52/405.1 |
| 5,876,550 | A * | 3/1999 | Feygin et al. | 156/264 |
| 5,921,046 | A * | 7/1999 | Hammond, Jr. | 52/564 |
| 5,956,500 | A * | 9/1999 | Shimmell | 703/7 |
| 6,006,480 | A * | 12/1999 | Rook | 52/309.12 |
| 6,145,270 | A * | 11/2000 | Hillman | 52/834 |
| 6,164,034 | A * | 12/2000 | Roetheli et al. | 52/560 |
| 6,182,409 | B1 * | 2/2001 | Visser | 52/309.13 |
| 6,182,891 | B1 * | 2/2001 | Furuhashi et al. | 235/379 |
| 6,185,891 | B1 * | 2/2001 | Moore | 52/309.7 |
| 6,205,728 | B1 * | 3/2001 | Sutelan | 52/309.7 |
| 6,460,301 | B1 * | 10/2002 | McKee | 52/235 |
| 6,460,302 | B1 * | 10/2002 | Neuhaus et al. | 52/261 |
| 6,721,684 | B1 * | 4/2004 | Saebi | 702/183 |
| 6,912,488 | B1 * | 6/2005 | Saebi | 703/1 |
| 6,985,932 | B1 * | 1/2006 | Glaser et al. | 709/219 |
| 2003/0079438 | A1 * | 5/2003 | Stephens et al. | 52/782.1 |
| 2004/0204903 | A1 * | 10/2004 | Saebi | 702/167 |

* cited by examiner

*Primary Examiner*—Richard E Chilcot, Jr.
*Assistant Examiner*—Mark R Wendell
(74) *Attorney, Agent, or Firm*—Albert W. Davis, Jr.

(57) ABSTRACT

The invention forms a composite building by using beams made from plastic foam coated with fiber reinforced concrete.

16 Claims, 42 Drawing Sheets

COMPOSITE BOX BUILDING AND THE METHOD OF CONSTRUCTION

CROSS-REFERENCE TO RELATED APPLICATIONS

This application is a continuation of Ser. No. 10/897,657 filed Jul. 21, 2004 now abandoned by Nasser Saebi for COMPOSITE BOX BUILDING AND THE METHOD OF CONSTRUCTION.

The following patents are hereby Incorporated By Reference: U.S. Pat. No. 6,308,490 issued Oct. 30, 2001 to Nasser Saebi for Method Of Constructing Curved Structures As Part Of A Habitable Building and U.S. Pat. No. 6,721,648 issued Apr. 13, 2004 for a Method Of Manufacturing And Analyzing A Composite Building.

BACKGROUND OF THE INVENTION

The concept of a building formed of a composite of foam coated with concrete or cement started over fifty years ago. The fact that such buildings are not in wide use is not because they are inferior structures to houses built from wood. Their scarcity is due to the fact that any new method of manufacturing buildings confronts the problem of proving to the various government organizations that such a house or building can meet the code requirements. This proof is not easily or inexpensively done. Further, each different design of house would be required to have a similar proof to be acceptable.

Many of the designs for foam-concrete composite buildings have not been cost effective. Other designs have not been able to span very large distances thereby severely limiting the size of their rooms.

These problems and others have been caused by the inability of the designers to analyze the strength of the composite buildings. Most conventional buildings, which have three components (structural framing, interior sheathing and exterior sheathing), fit into a simple mathematical format and can be analyzed by classical mathematical methods. Buildings using composite construction materials are complex to analyze and can not be solved classically. U.S. Pat. No. 6,721,648 explains how to analyze a composite building using Finite Element Analysis (FEA).

BRIEF SUMMARY OF THE INVENTION

The invention is a distillation of the testing and analysis of many models using FEA.

The invention uses beams and panels constructed from EPS (Expanded PolyStyrene) foam to form the walls and ceiling/roof of a composite box building. The walls are formed by columns which are either H-shaped columns or solid panel columns depending on the strength needed at the particular location. The beams for the ceiling can be I-shaped. The columns and beams can be formed from commercially available sizes of EPS foam by cutting and joining using the appropriate bonding agent. The beams usually have all of their surfaces coated with GFRC (Glass Fiber Reinforced Concrete) to increase their strength.

Long beams for the ceiling can be made by joining smaller lengths, cut from standard length molded foam blocks, and by staggering the joints of the adjacent pieces. The walls are constructed in the same manner by staggering the joints of adjacent columns to form a saw tooth joint. This staggering allows the walls and ceiling to be made of any size by using standard 8-foot lengths of EPS foam.

The foundation and floor of the building is built of foam and then coated in part or whole with GFRC. The foundation is constructed upside down, coated on the bottom and then turn over. The foundation is placed on a leveled portion of the building site, and the building is then constructed on the foundation. Alternatively, the building or a portion of the building is manufactured at a facility and transported by truck to the building site.

Some internal portions of the columns and beams are coated with GFRC. A specially sized tool can be placed in the space created between adjacent columns or beams, and the coating is created when the tool is moved along the space.

Portions of the building that are found to be high stress points by FEA (Finite Element Analysis) can be reinforce by adding more GFRC to these highly stressed locations. GFRC is added to the web and inner surfaces of the flanges of the columns and beams to create the highest strength columns and beams. The building is coated with GFRC on the inner and outer surfaces to create its highest strength.

The building can be created in a CAD (Computer Assisted Design) program and then exported into a FEA program's stress solver, where it is divided up into pieces (finite elements) and analyzed.

The composite building can be made strong with superb sound proofing characteristics and energy efficiency.

The invention also discloses structural designs discovered by the analysis to be of great strength and low mass.

Since the strength of these buildings can now be analyzed, the following objects can now be provided:

It is an object of the invention to provide low cost housing with an acceptable appearance.

It is an object to provide a method of manufacture requiring less skill in the work force.

It is another object of the invention to produce houses that use easily assembled materials.

It is an object of the invention to provide a building that has a high insulation value to lower the energy consumption of the house.

It is a further object to provide a building that is better able to withstand the forces of an earthquake, and other forces of nature at an affordable price.

DETAILED DESCRIPTION OF THE INVENTION

Figure 1:
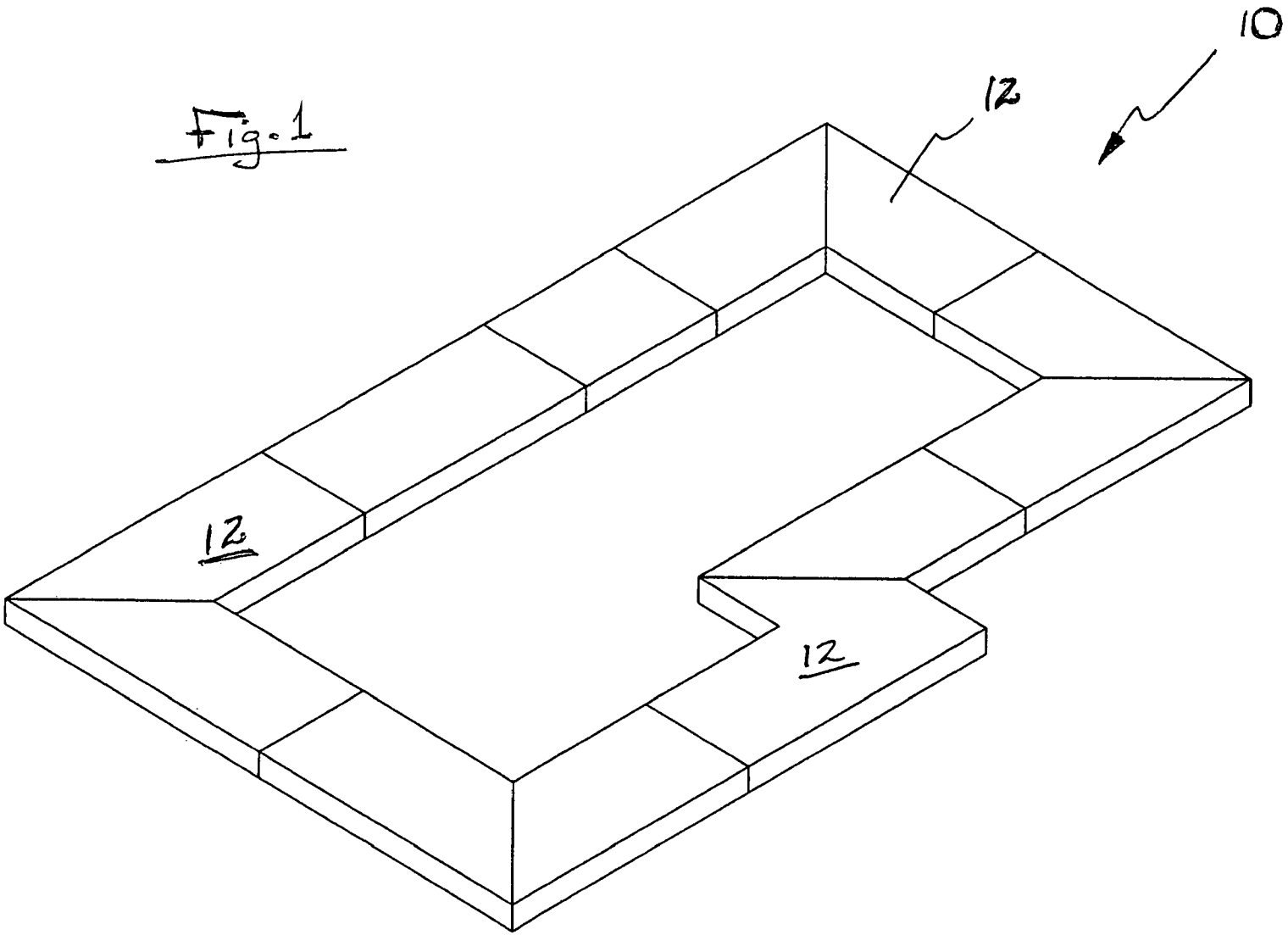
FIG. 1 is a perspective view of the start of the jig that can be used to construct the foundation.
Figure 2:
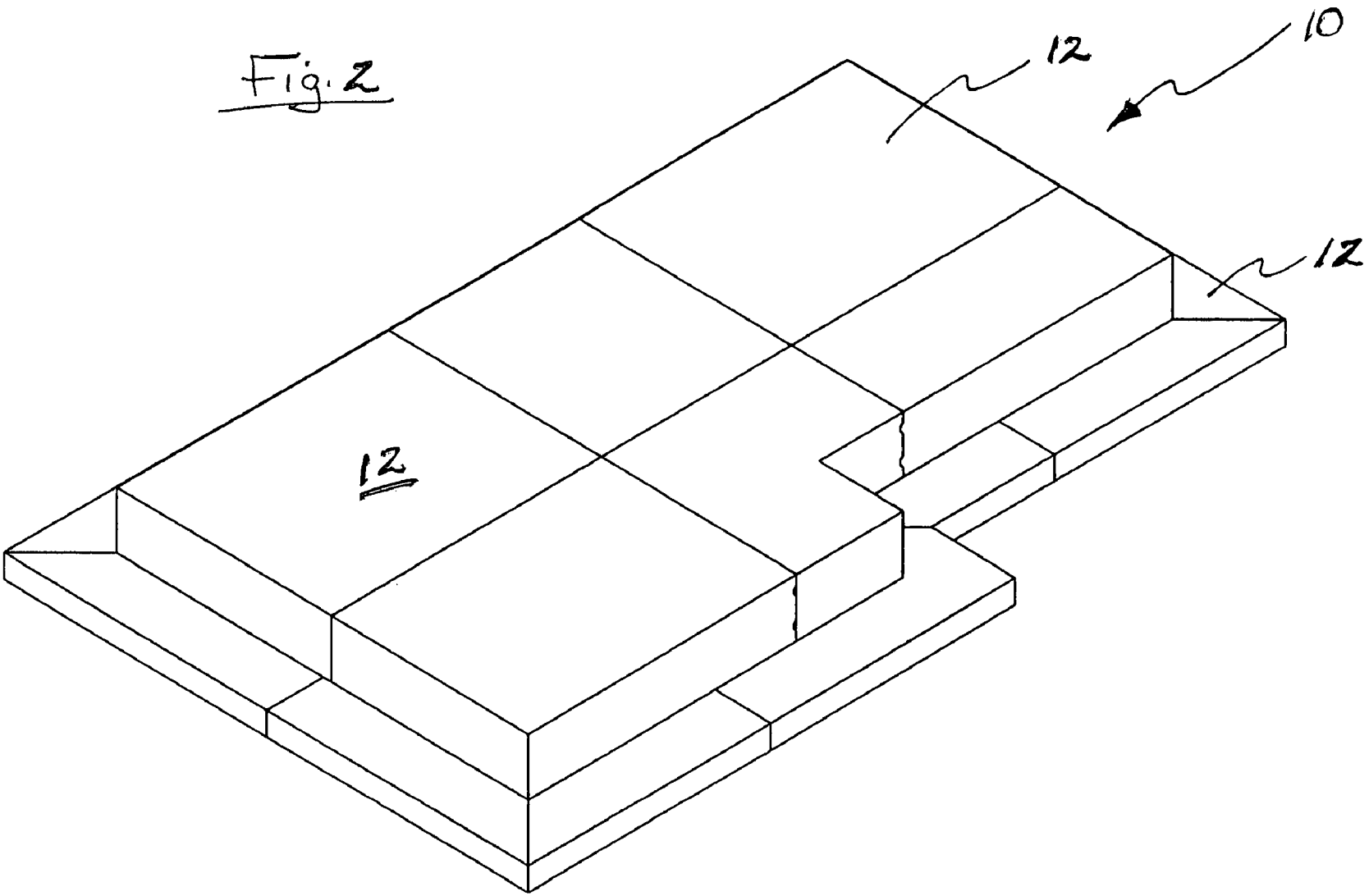
FIG. 2 is a perspective view of the second stage of the jig.
Figure 3:
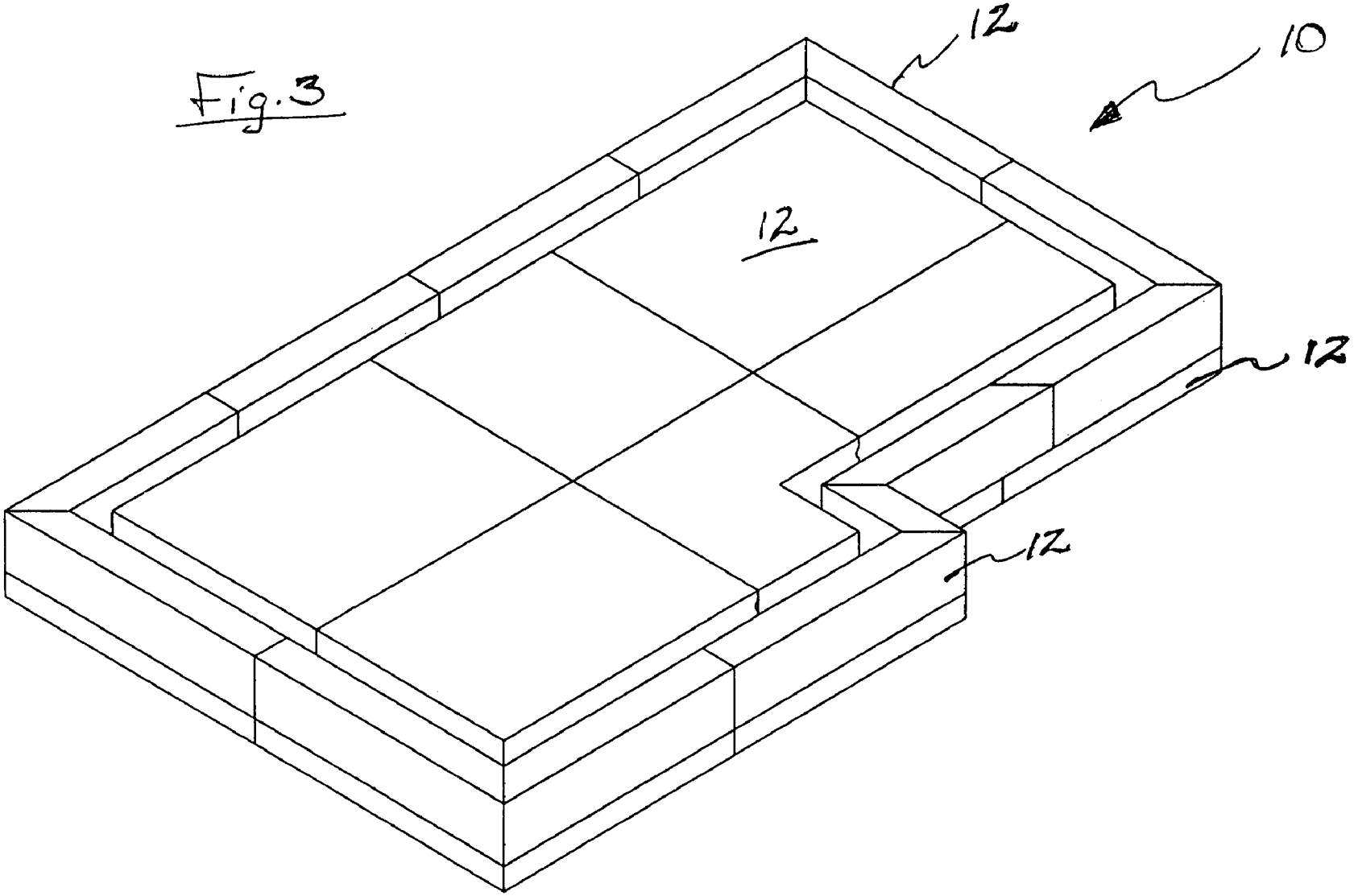
FIG. 3 is a perspective view of the completed jig.
Figure 23:
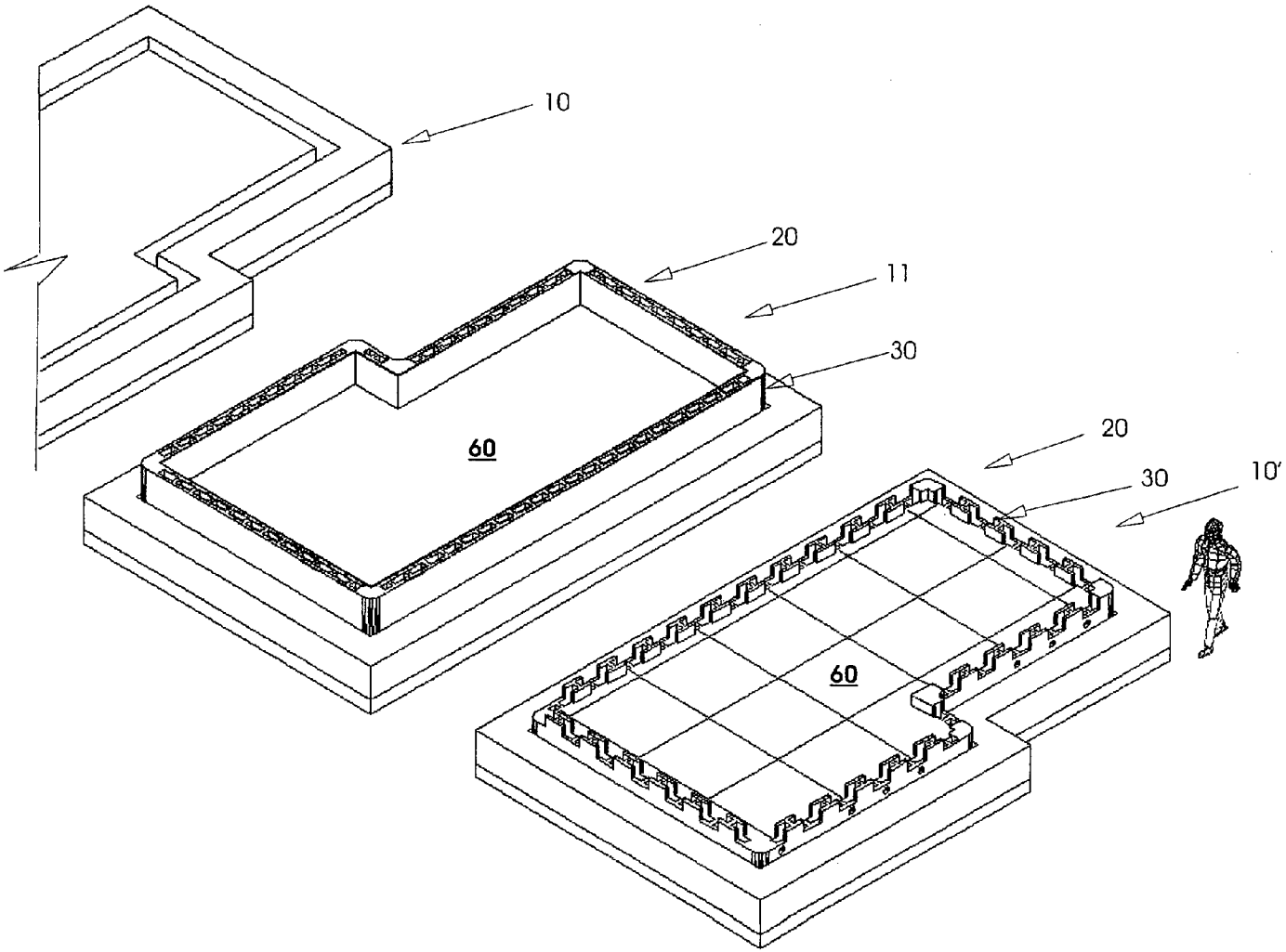
FIG. 23 is a perspective view of the three jigs that can be used to manufacture the foundation and the overall building.

FIGS. 1-3 show a jig 10 being assembled from elements 12. The elements 12 can be formed from wood, metal, foam or GFRC coated foam. FIG. 23 shows three jigs 10, 11 and 10' that can be used to assist in manufacturing the building. Jig 11 is the mirror opposite of jig 10 so that jig 11 can receive the foundation 20 when it is flipped over and inserted after being removed from jig 10.

Figure 4:
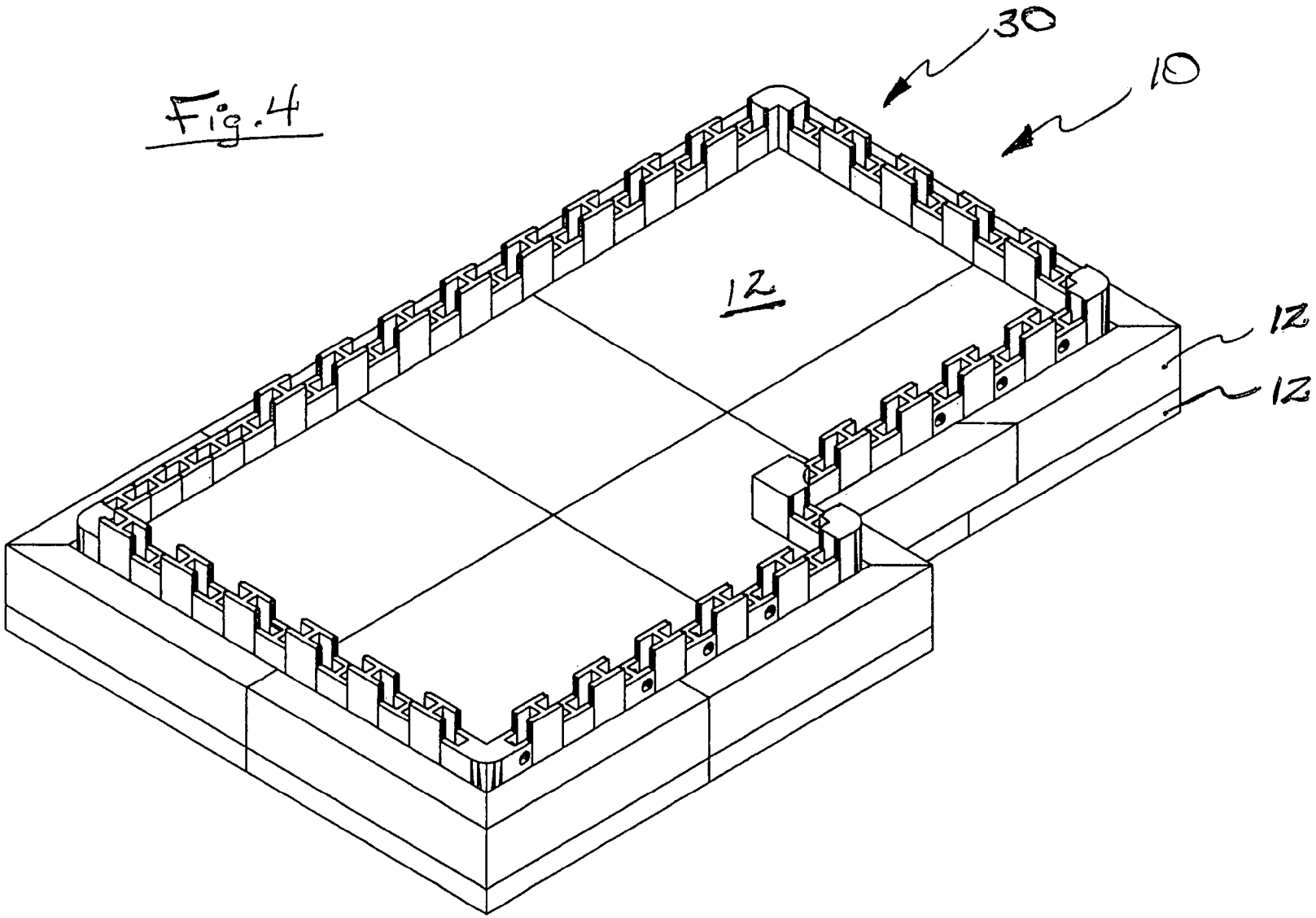
FIG. 4 is a perspective view of the jig with the columns of the first level in place.
Figure 5:
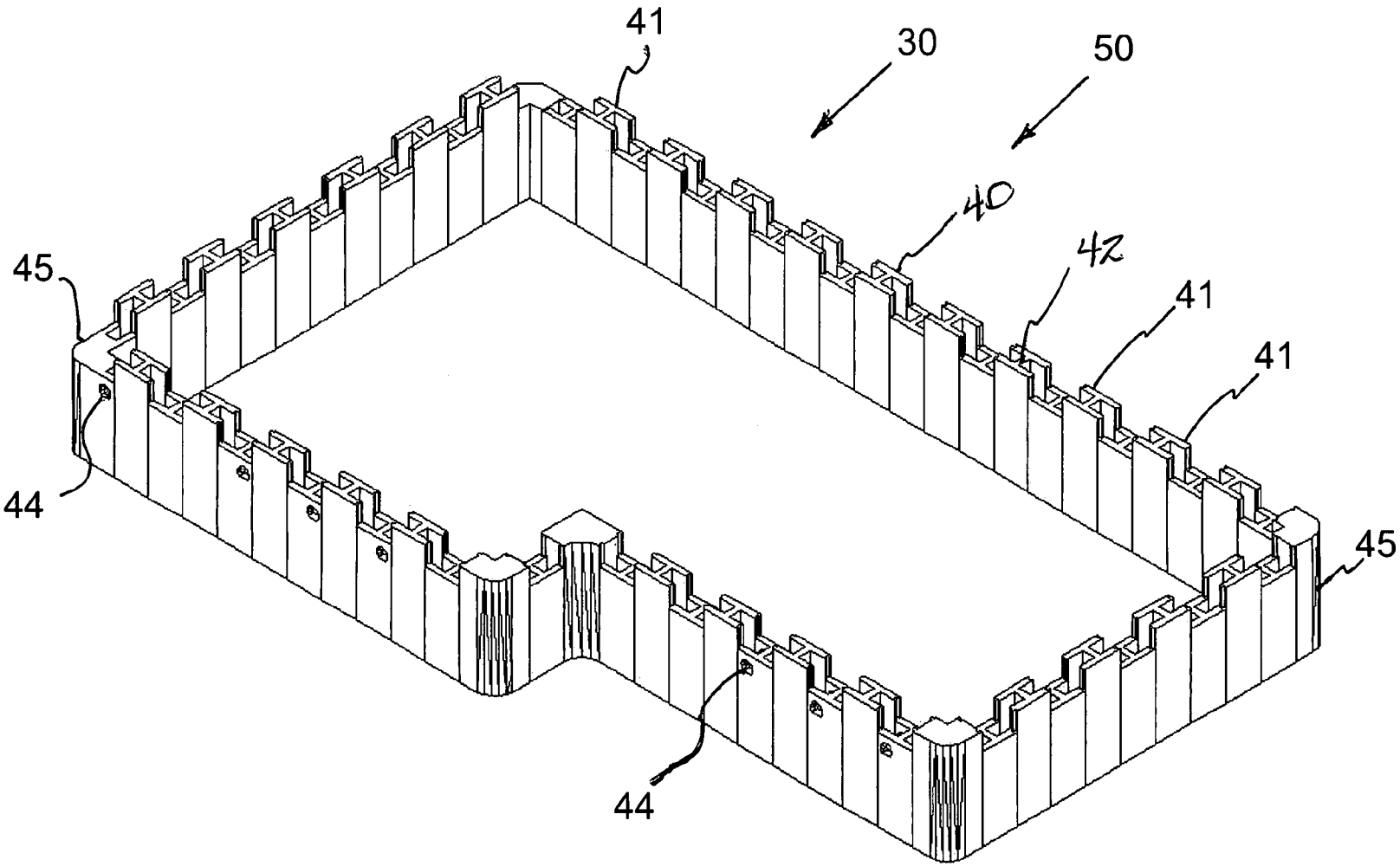
FIG. 5 is a perspective view of the first level of columns with jig removed.

FIGS. 4 and 5 show the first level of columns 30 assembled in the jig 10 and with the jig removed, respectively. The columns 40 are formed in a H shape. That is the legs/flanges 41 are longer than web 42. In an I-shaped beam, the legs are shorter than the web. The columns 40 can have tongue and groove edges as shown at 86, 87 of FIGS. 14 and 46, 47 of FIG. 41 to help in assembly and to add strength. The side wall 50 formed by the columns 40 which are, for example, 8 inches in thickness and 2 feet or less in width. The column 40 can be assembled from pieces of foam and glued together, extruded, cast or cut from a foam block. Each column 40 is, for example, formed with a leg and web thickness of 2 inches making the void between the legs of 4 inches. The columns 40 are made in two lengths, such as a 1 foot length and a 1.5-foot length. When assembled next to each other, the two different length beams form staggered joint ends. The staggering of the ends allows the joint areas to be in different portions of the side wall 50; thereby increasing the strength of the building. The overlap can be 2 feet. Holes 44 are provided to allow concrete to pass through the columns to the interior of the foundation 20 when the footings are formed in trench 110 (FIGS. 35-40). The corner pieces 45 are formed from solid foam by extrusion or cutting.

Figure 6:
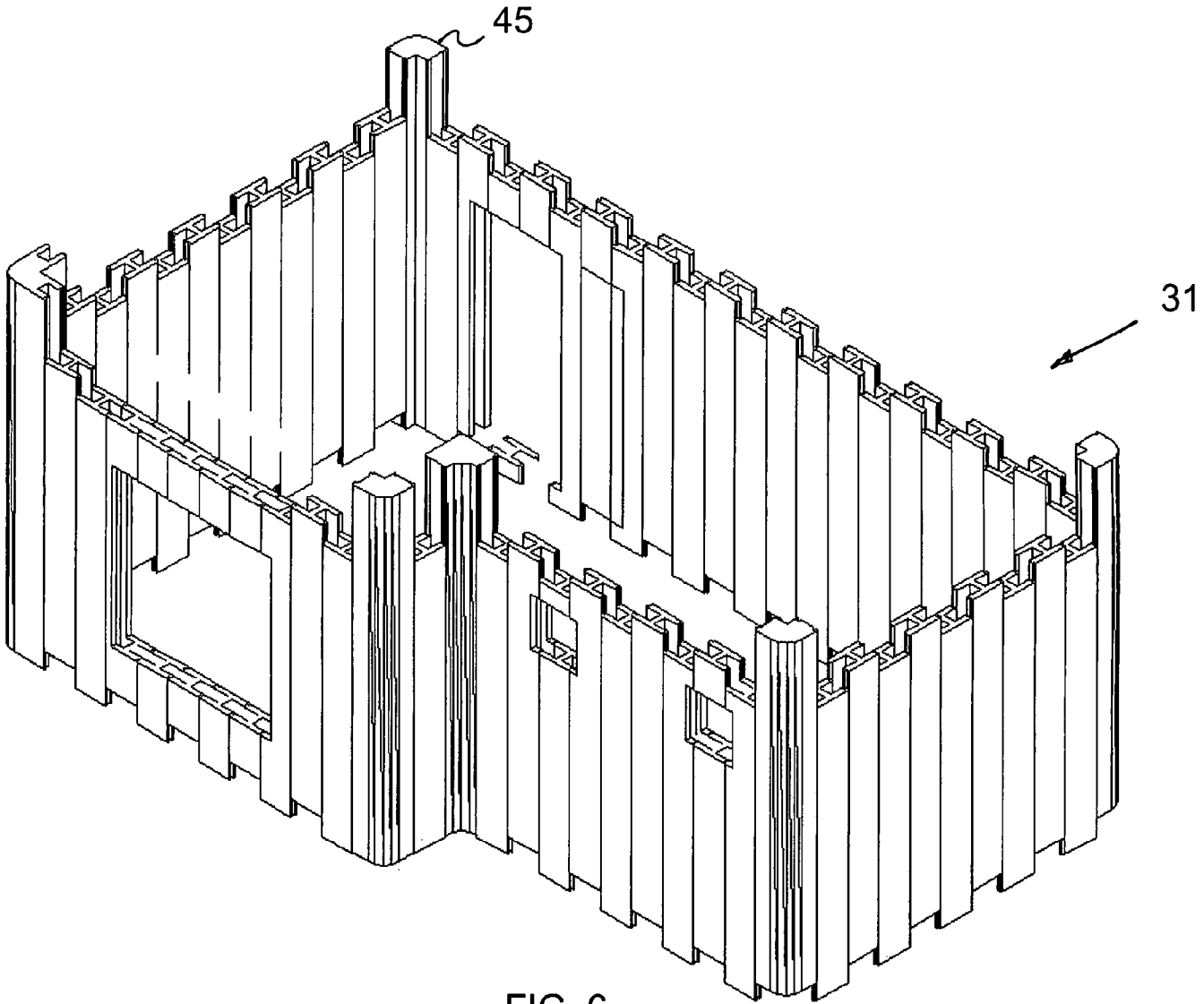
FIG. 6 is a perspective view of the second level of columns.
Figure 7:
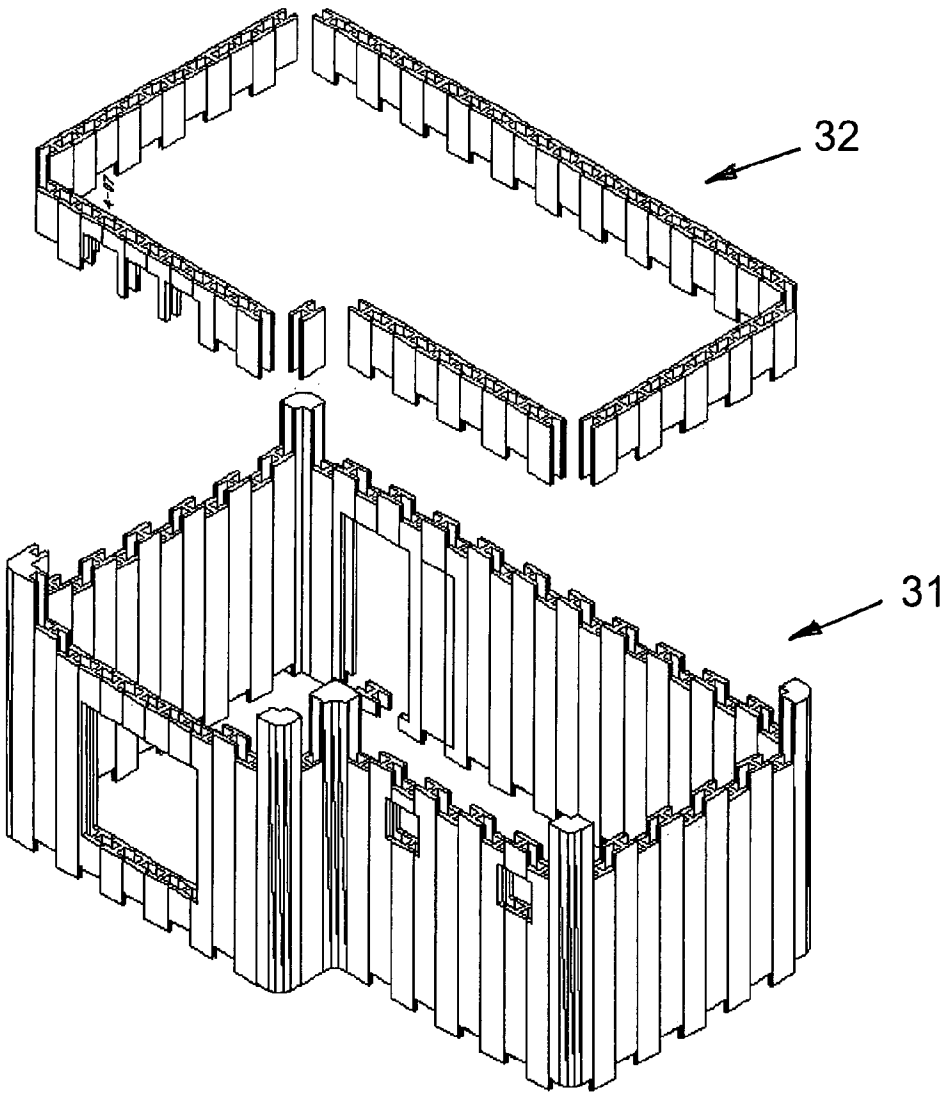
FIG. 7 is an exploded perspective view of the second and third levels of columns.
Figure 8:
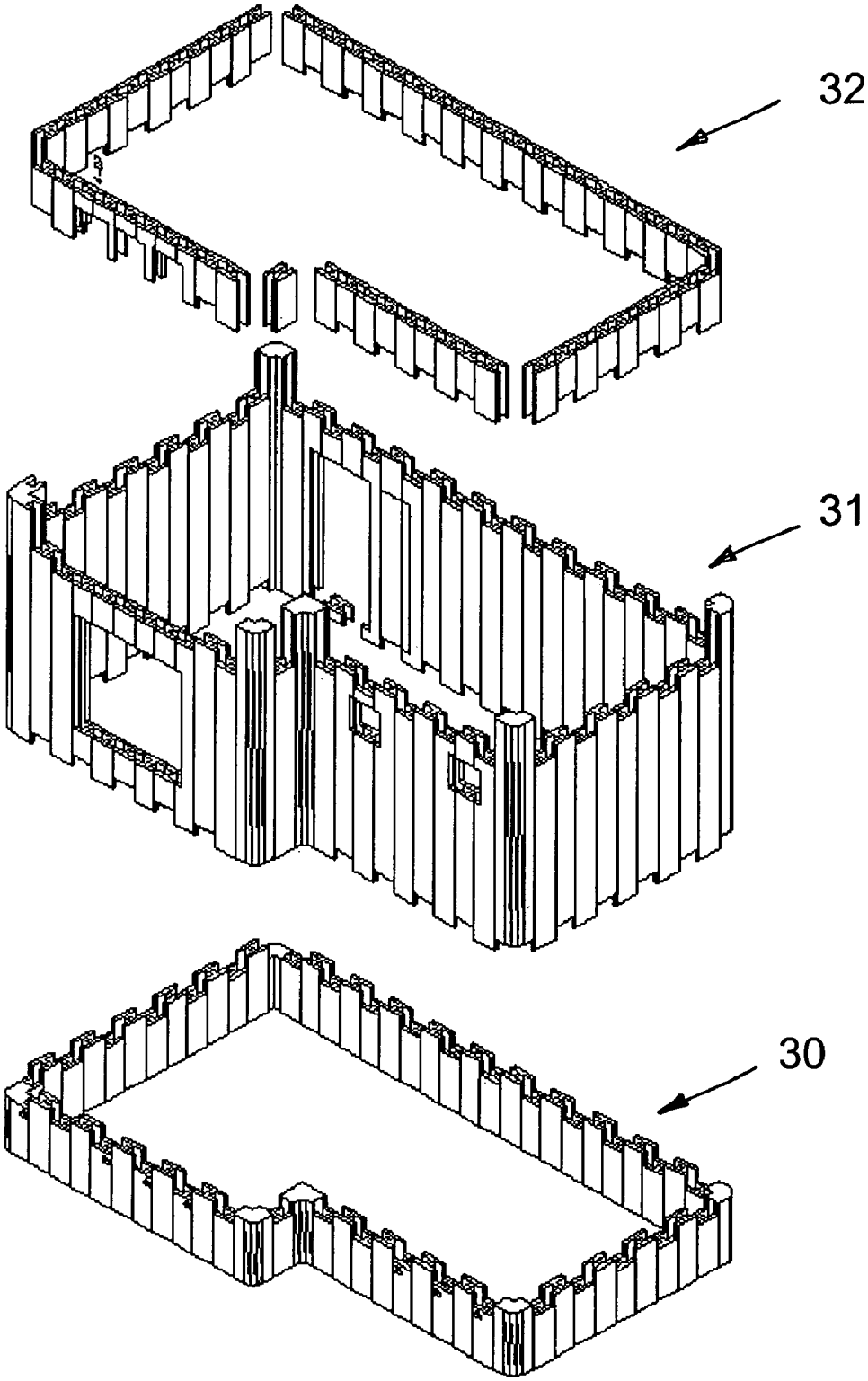
FIG. 8 is an exploded perspective view of the first, second and third levels of columns.

FIGS. 6-8 show the second and third levels of columns 31 and 32 that make up the side walls 50 of the building exterior. The total length of the columns in the side wall can be 1.5 feet in the foundation, or as deep as the ground frost requirement dictates, and 10 feet to the ceiling for a total length of 11.5 feet. The side wall 50 would be made from standard 8 foot pieces of plastic foam bonded together. Most foam cutting machines are designed to handle 8 foot blocks or pallets of foam. However, it is possible to use custom size foam blocks or pallets and customized cutting tools. The preferred plastic foam is Expanded PolyStyrene (EPS).

Figure 9:
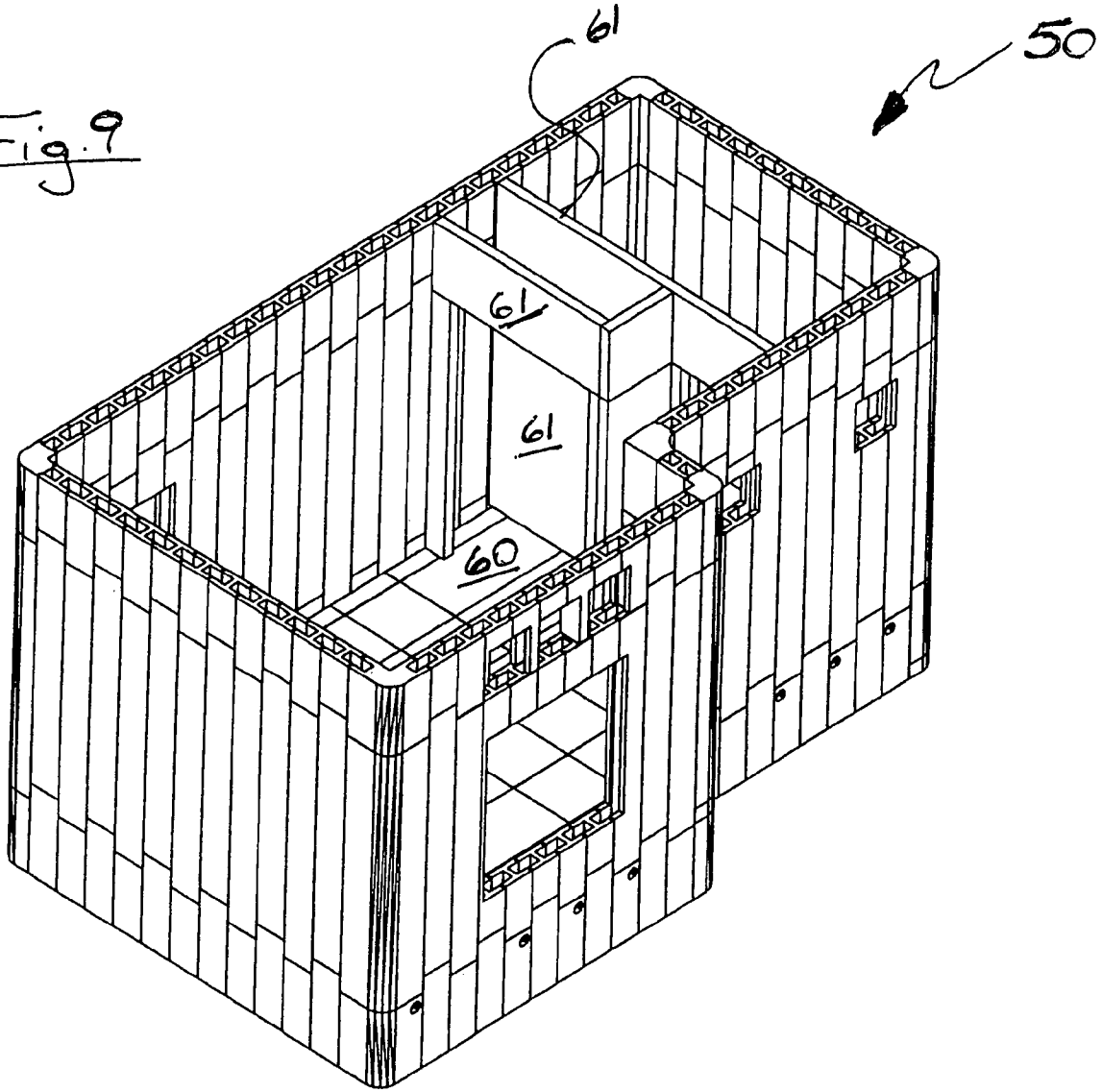
FIG. 9 is a perspective view of the first, second and third levels of columns in place.

FIG. 9 shows the side walls 50 fully assembled with floor 60 and interior walls 61. The floor 60 which rests on the leveled lot and interior walls 61 can be constructed of solid foam panels since the stress loads on these elements is not as high as in the outer walls.

Figure 10:
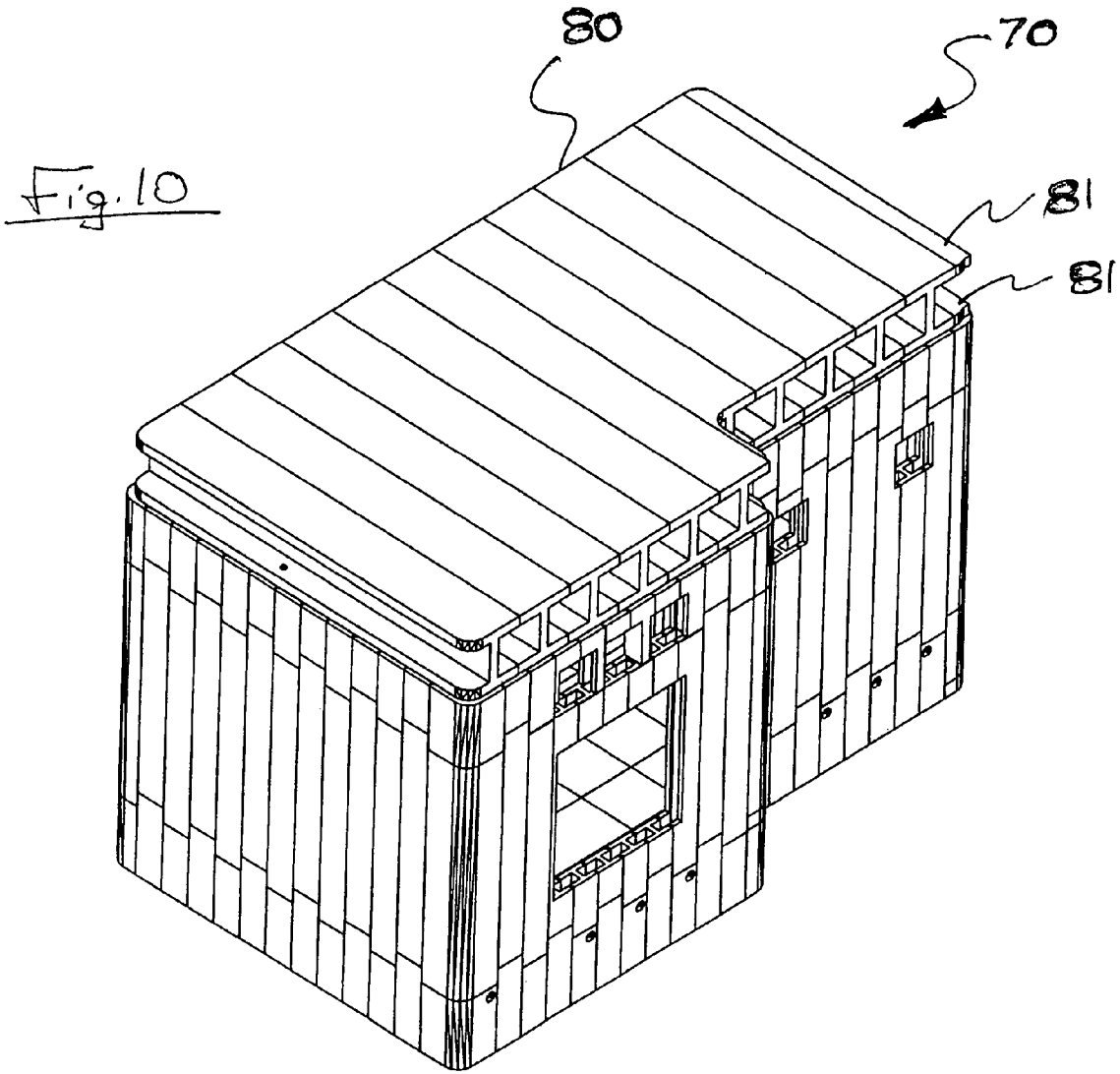
FIG. 10 is a perspective view of the first, second, third level columns and the ceiling/roof beams in place.

FIG. 10 shows the ceiling/roof 70 formed from I-shaped beams 80 added to the building. The bottom flange of the I-beam forms the ceiling, and the top forms the roof. Filler pieces 81 can be added to the ceiling beams 80 to make them fit the desired areas.

Figure 11:
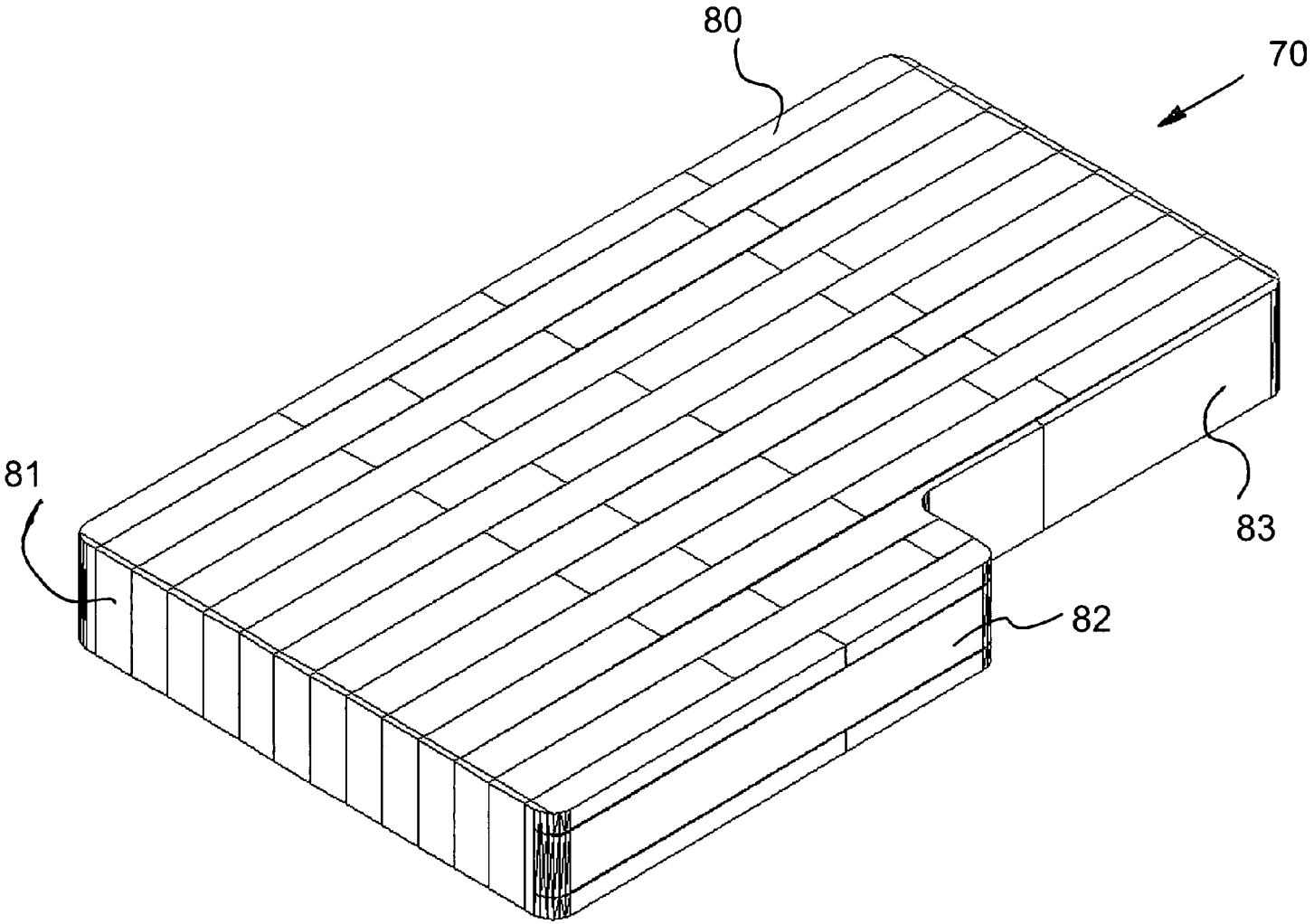
FIG. 11 is a perspective view of the ceiling/roof beams and the outer cover pieces for the beams.

FIG. 11 shows the ceiling/roof 70 assembled. Designators L and R refer to the pieces of foam making up the Right and Left pieces of the I-beams 80. The outer edges of the beams 80 are covered with end covers 81, fill pieces 82 and side covers 83 of foam.

Figure 12:
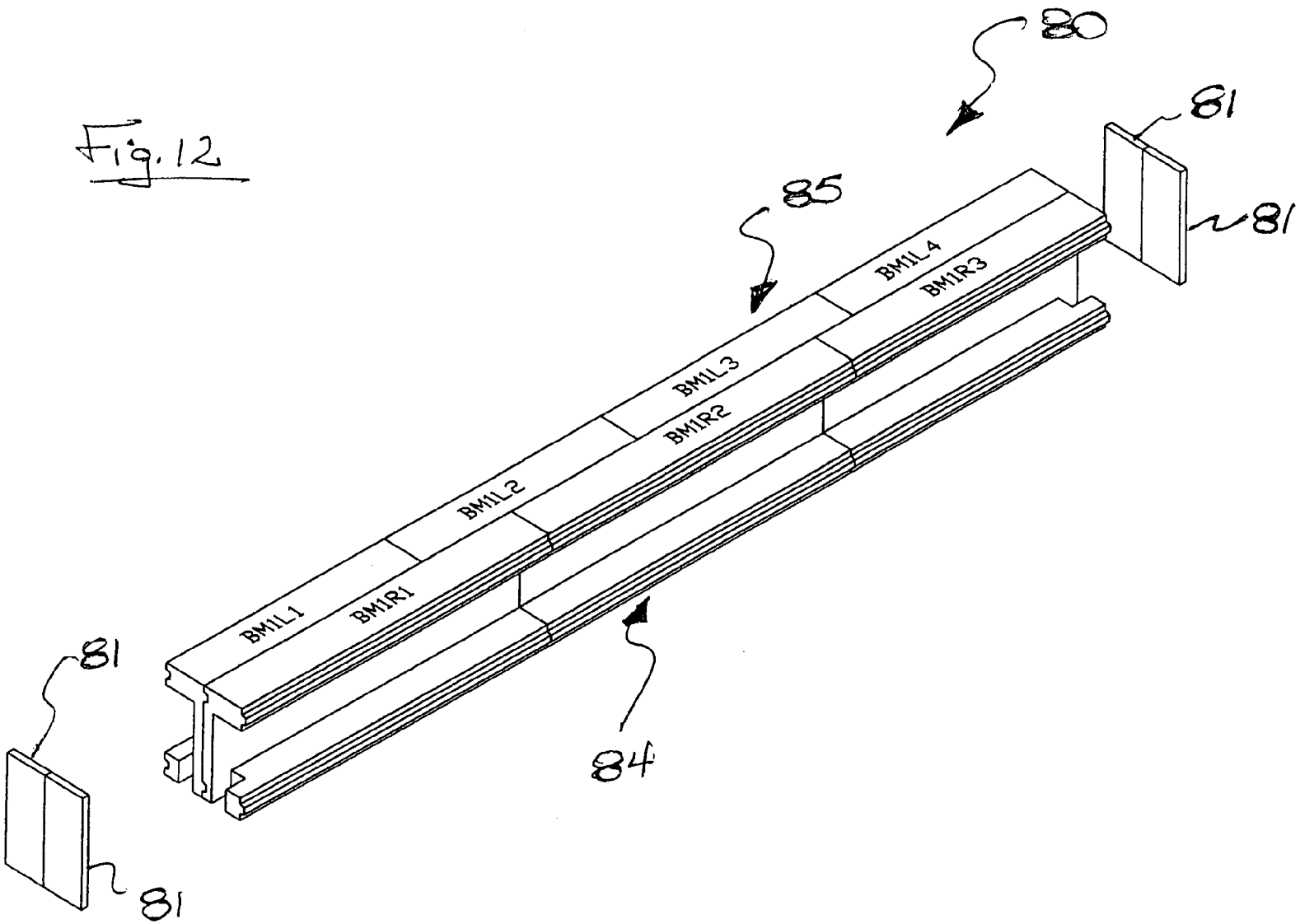
FIG. 12 is a perspective view of one ceiling/roof beam.

FIG. 12 shows the foam pieces making a ceiling/roof beam 80 having a web 42 and legs 41. These pieces 84, 85 can be assembled from pieces of foam and bonded together, extruded, cast or cut from a foam block. The pieces 84, 85 are cut to stagger the joints between the ends to increase the strength of the beam. By using beams as opposed to panels, far greater distances can be spanned by the ceiling while maintaining the required strength.

Figure 13:
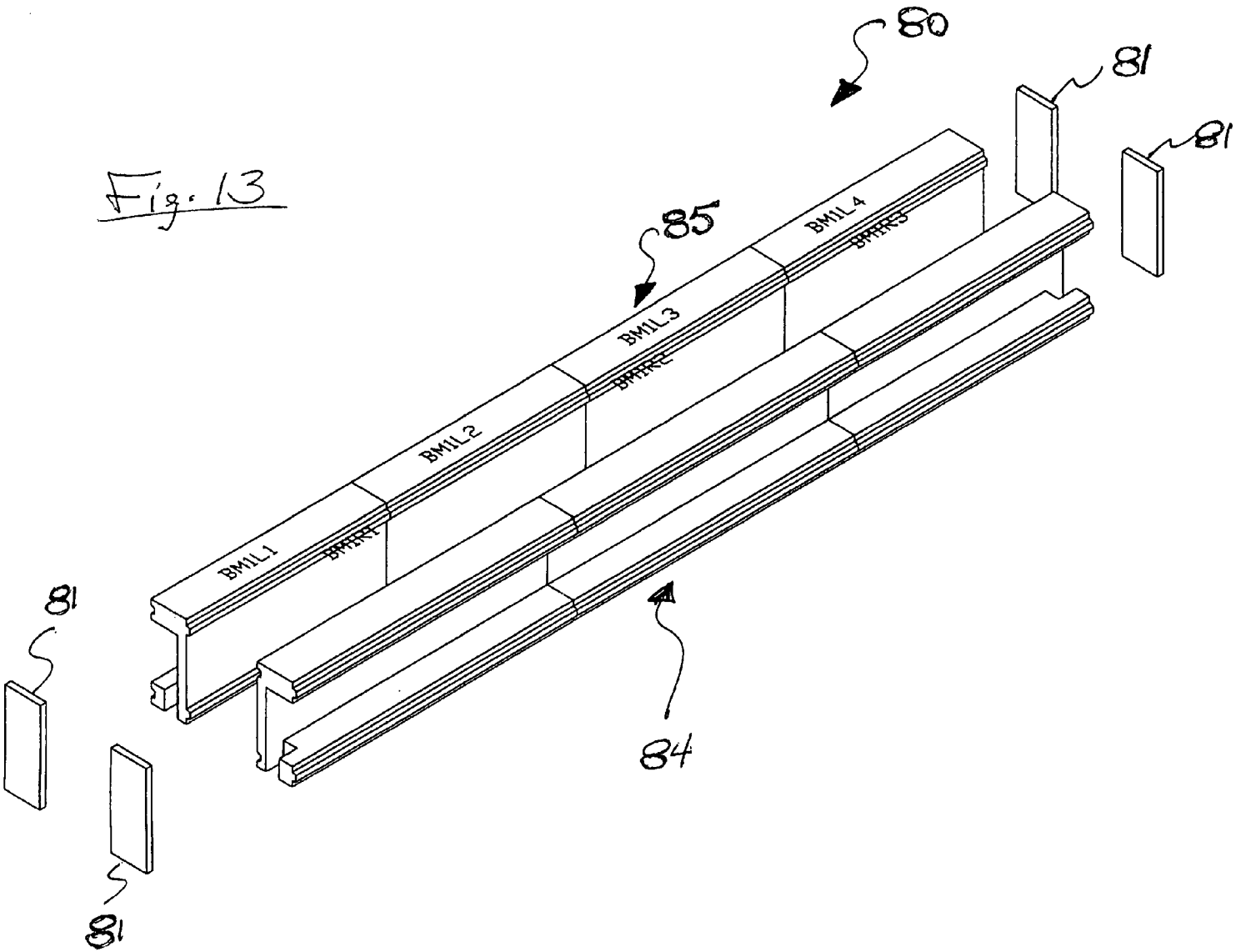
FIG. 13 is an exploded perspective view of the pieces making up a ceiling/roof beam.

FIG. 13 shows a beam 80 with the halves 84, 85 separated. Each half can be made and then the halves joined to form the beam in FIG. 12.

Figure 14:
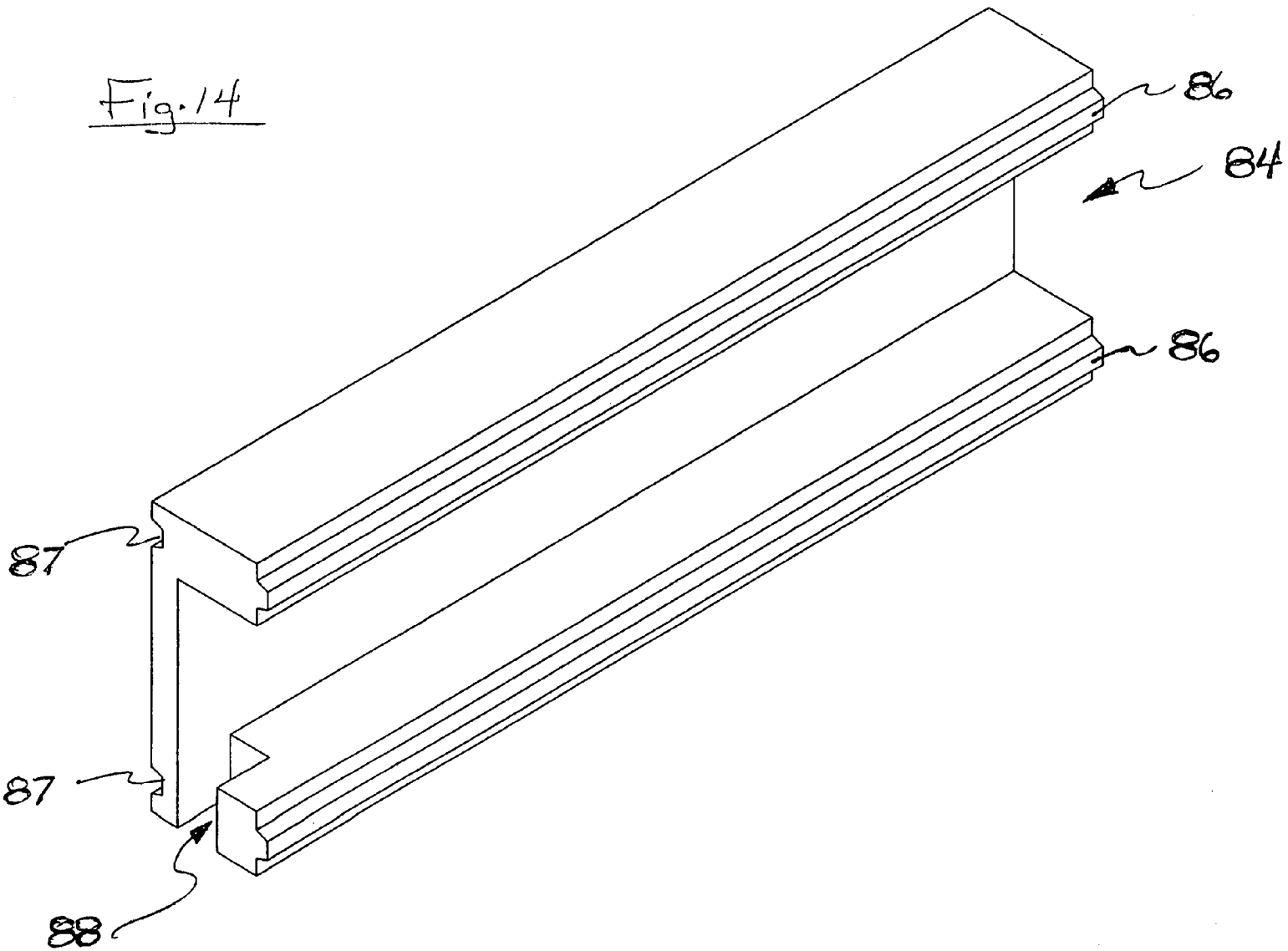
FIG. 14 is a perspective view of a right side portion of the ceiling/roof beam.

FIG. 14 shows a Right side piece 84 of a ceiling/roof beam 80. Like the side wall columns 40, the ceiling beams 80 can be made with tongue 86 and groove 87 portions to add strength and ease of assembly. But, there is usually no need for the tongue and groove in the ceiling beam design. At each end of the beam 80, a cut-out portion 88 is provided to transfer the load of the beam through the coating on the ceiling/roof beam to the top end of the side wall column 40. All of the surfaces of the beam at the cut-out 88, including the lower edge, are coated with GFRC to form the area of load transfer. The coating in this area may be thicker to facilitate the transfer of the load through the coating on the outside surfaces of the ceiling/roof beam 80 on to the coating of the side wall columns 40. The cut-out 88 portion is used when the beam 80 rests on a side wall portion made from H columns and is located within the side wall.

If the side wall is made of solid columns 120, the cut-outs 88 are not needed, and the foam of the underside of the flange of the beam 80 is bonded to the foam top of the solid column 120. The interior portions of the beam (the legs and the web) have been previously coated with GFRC. In other situations, it may be possible to omit the cut-out 88 and just coat the top of the H column wall portion 40 and the underside of the flange of the beam 80. In that situation, the GFRC coatings rest on each other and a further GFRC coating is added on the inside and outside surfaces of the building, as in all of the buildings. In the final form, all surfaces of the beam 80 are coated with GFRC, even though the surfaces may be coated at different times during the construction process.

Figure 15:
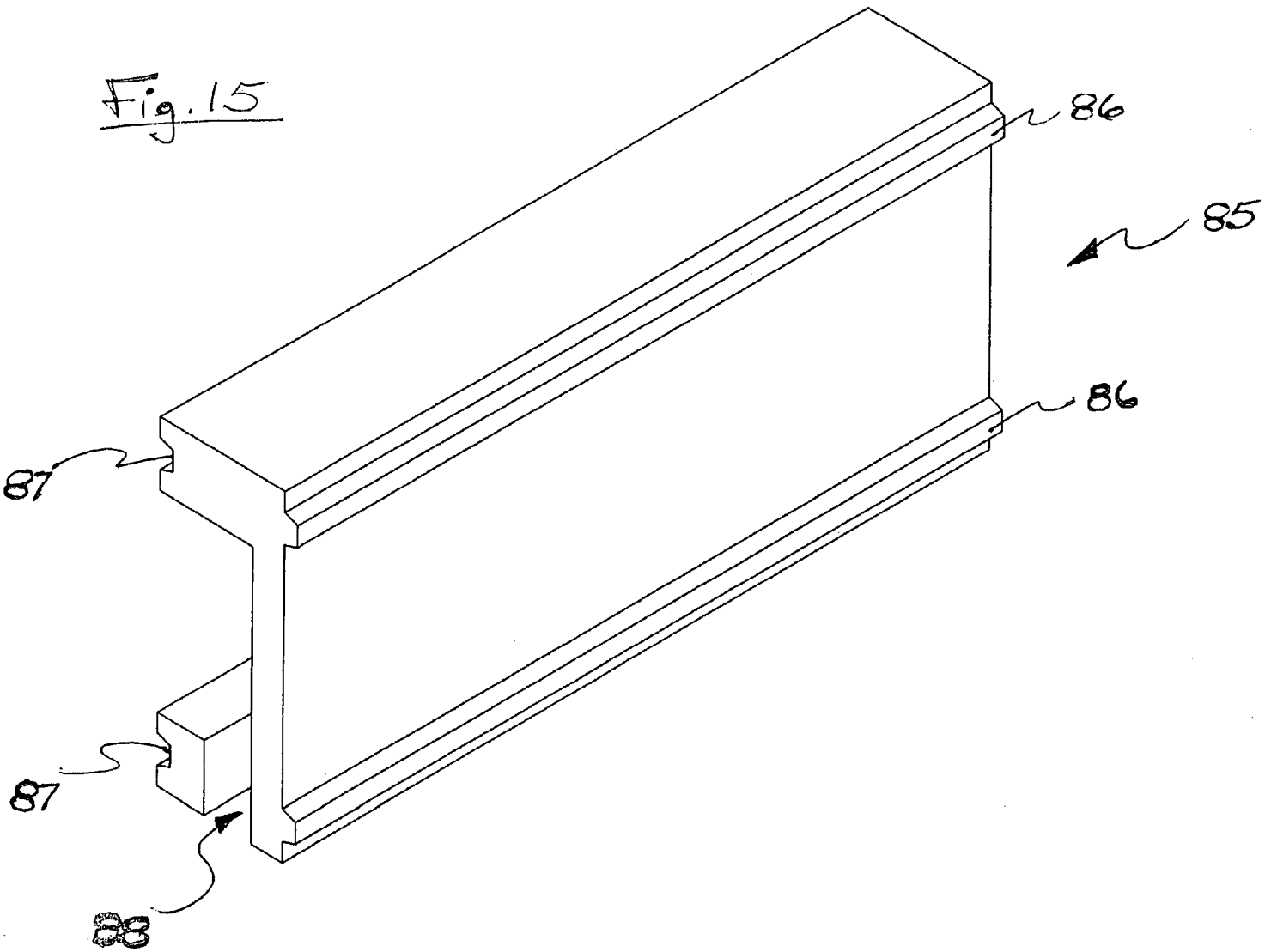
FIG. 15 is a perspective view of a left side portion of the ceiling/roof beam.

FIG. 15 shows a Left side piece 85 of a ceiling/roof beam 80. The Left and Right side pieces 85 and 84 are joined by a bonding agent to form a portion of the beam. Then, the beam 80 is coated with GFRC on the inner surfaces of the legs 41 and the opposed surfaces of the web 42 of the I-beam to form a C or U-shaped coating on each inner surface of the beam 80 and thereby provide the necessary strength to allow the beam to be handled and stood upon during construction. The coating of GFRC is not shown so that the piecing of the foam can be more clearly shown.

Figure 16:
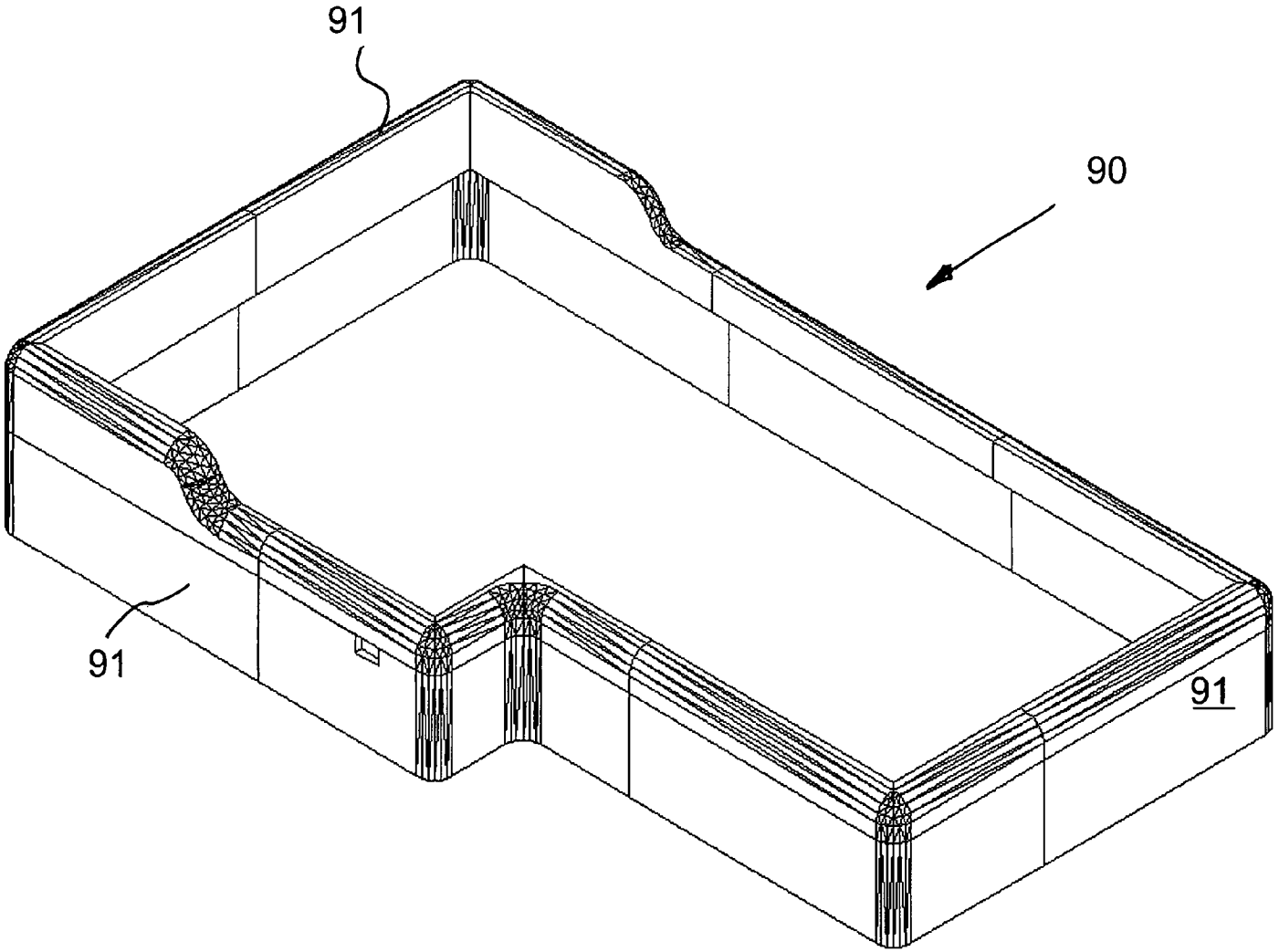
FIG. 16 is a perspective view of the parapet wall.

FIG. 16 shows the parapet wall 90 which is made of foam pieces 91 which are joined by a bonding agent.

Figure 17:
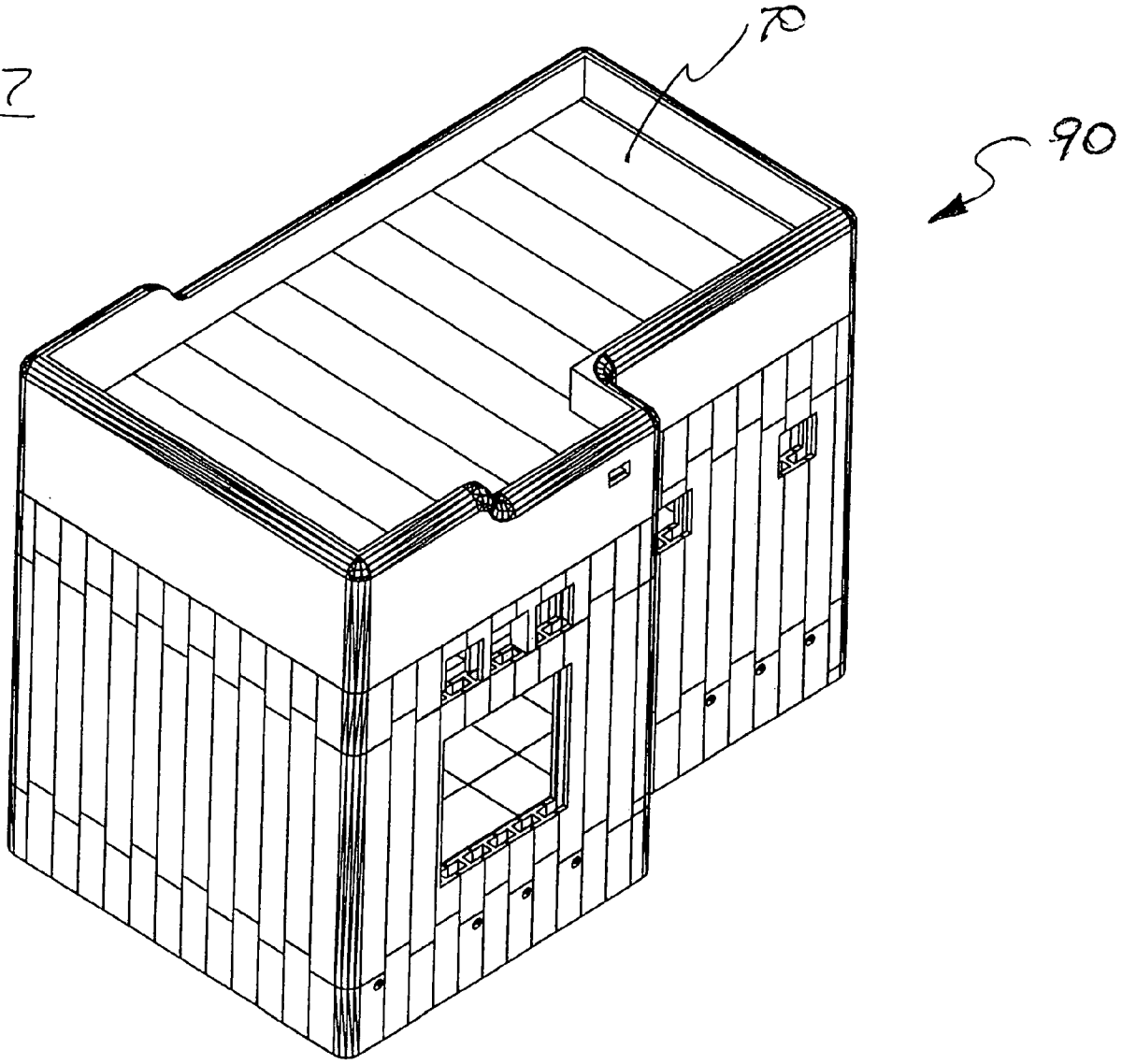
FIG. 17 is a perspective view of the overall building.

FIG. 17 shows the parapet wall 90 in place on the roof 70.

Figure 18:
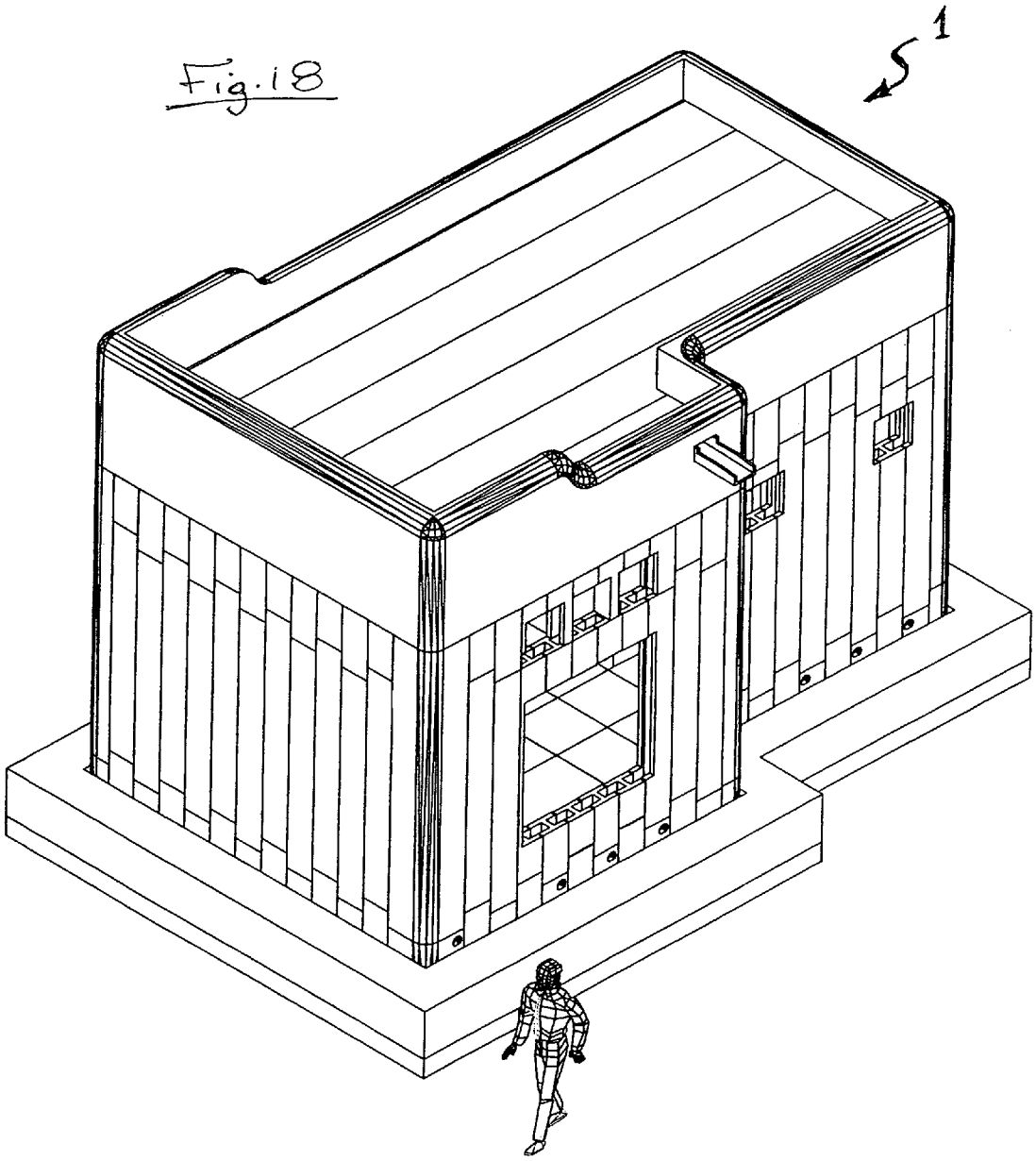
FIG. 18 is a perspective view of the overall building with the jig in place.
Figure 19:
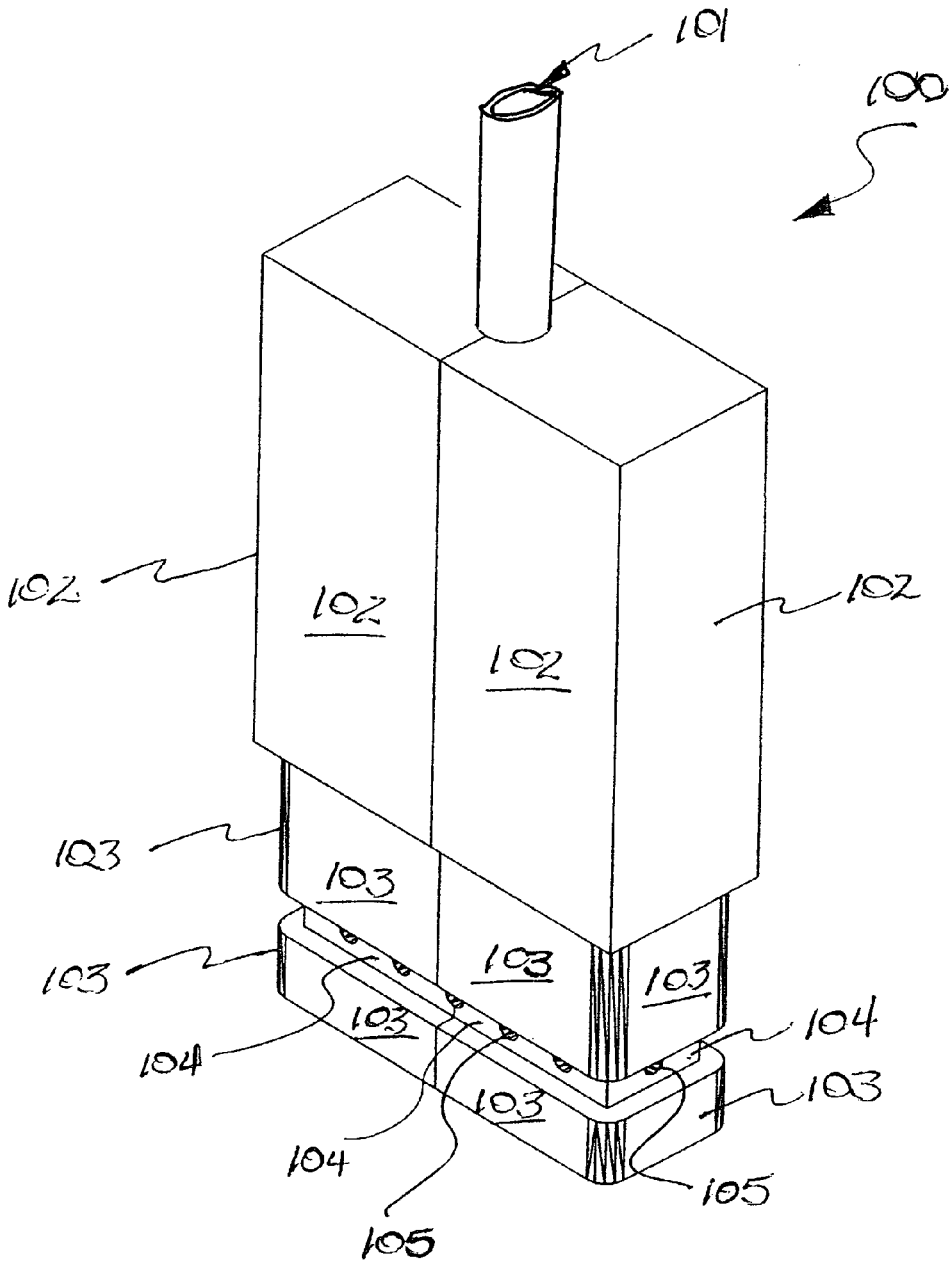
FIG. 19 is a perspective view of a tool that can be used to coat the insides of the columns or beams.
Figure 20:
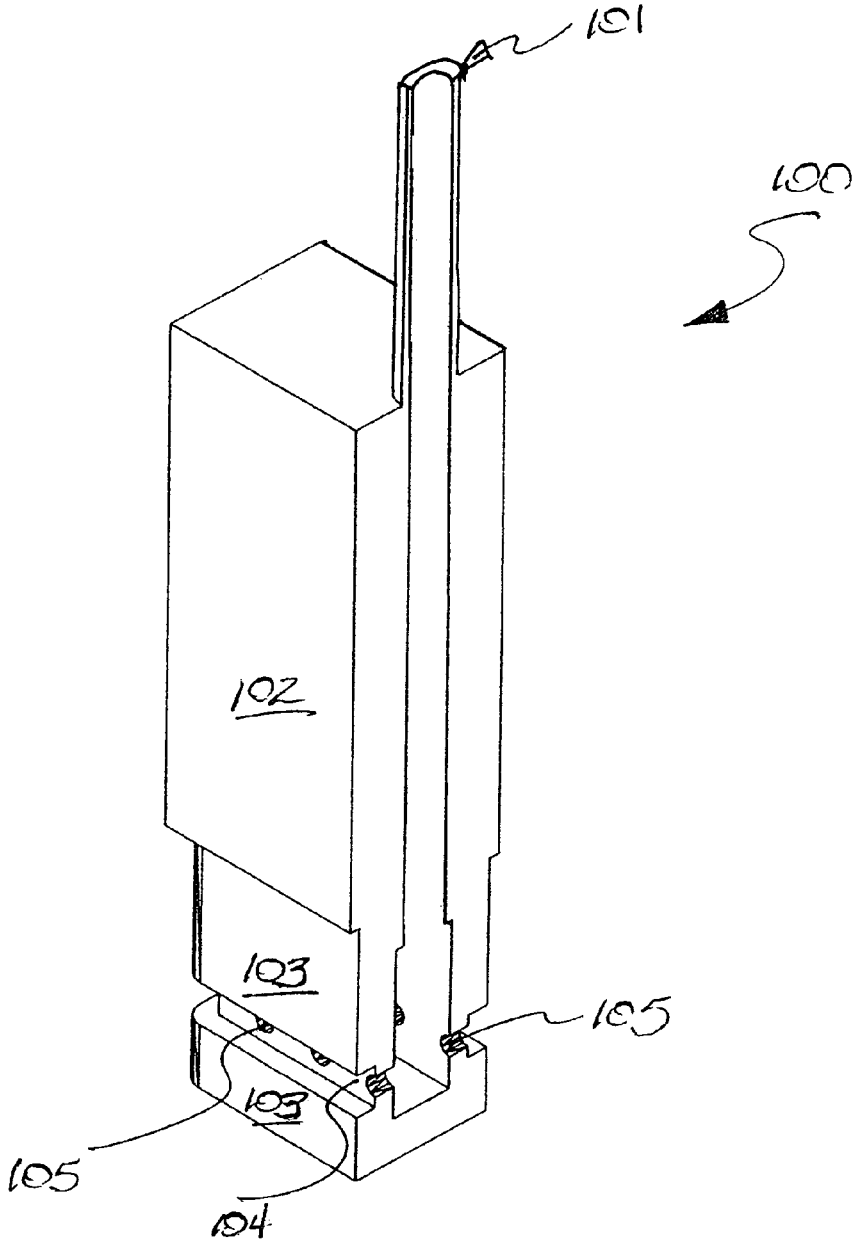
FIG. 20 is a perspective view of the tool cut down the center.
Figure 21:
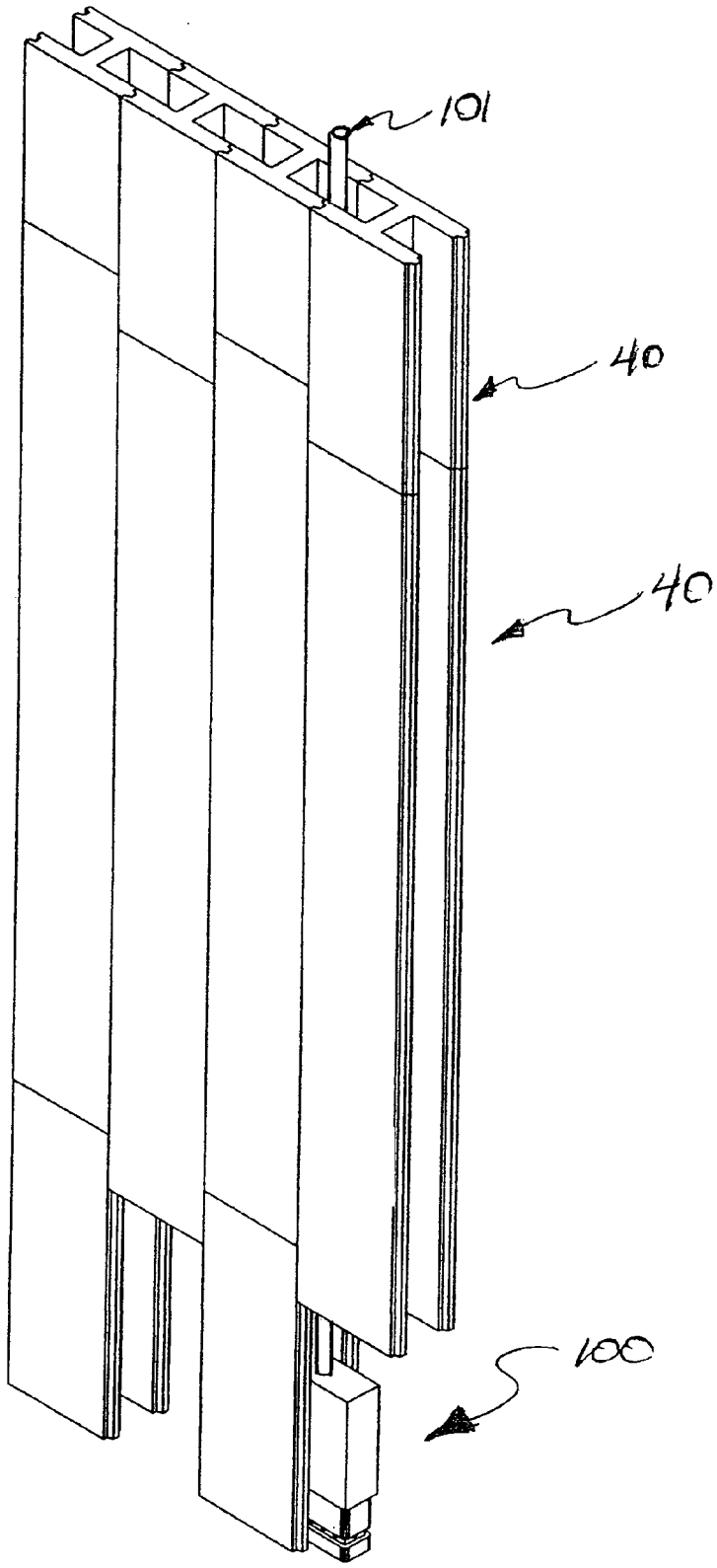
FIG. 21 is a perspective view of the tool in use with some of the columns or beams removed to show the tool.
Figure 22:
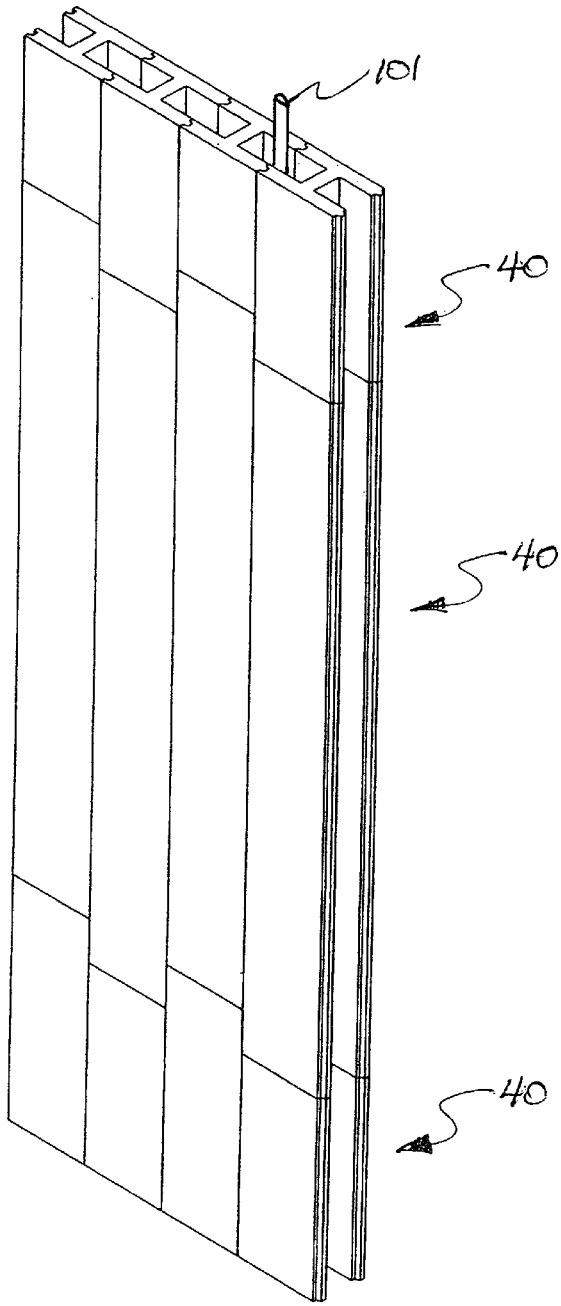
FIG. 22 is a perspective view of the tool in use.

FIG. 18 shows the completed foam building in the jig 10'. Some or all of the internal surfaces of the columns making up the side walls and the beams making up the ceiling/roof have been coated with GFRC to add the necessary strength. The building's exposed surfaces are coated with GFRC to increase the strength of the building and protect the foam.

FIGS. 19-22 show a tool 100 which can be used to coat the interior surfaces of the columns and beams. Tool 100 has a hose 101 that brings the GFRC to the tool. Surfaces 102 create a rectangular cross-sectional dimension that is slightly less than the rectangular cross-sectional dimensions of the void created between two joined H beams 40. Surfaces 103, 104 create progressive smaller rectangular cross-sections. Orifices 105 in surface 104 feeds the GFRC from hose 101 into the gap between surfaces 104 and the columns or beams inner surfaces. The tool 100 is moved through the internal space to coat the columns or beams.

FIG. 23 shows the three jigs 10, 11 and 10' that can be used to manufacture the foundation 20 which is formed from the floor 60 and the first level of H columns 30 of the side wall 50. The foundation 20 is shown in each jig as it would be positioned during manufacture. The foundation 20 is created by joining panels of EPS foam to each other to form the floor 60 and to the side wall 30 by a bonding agent in jig 10. The foundation 20 can then be coated with GFRC on its other surfaces and allowed to cure. The foundation 20 then is lifted out of jig 10 and turned over and inserted in jig 11 where the foundation 20 can be coated with GFRC and allowed to cure. Both the upper and lower sides of the floor 60 can be coated. The foundation is then flipped over again and inserted in jig 10' where the rest of the building can be added.

Figure 24:
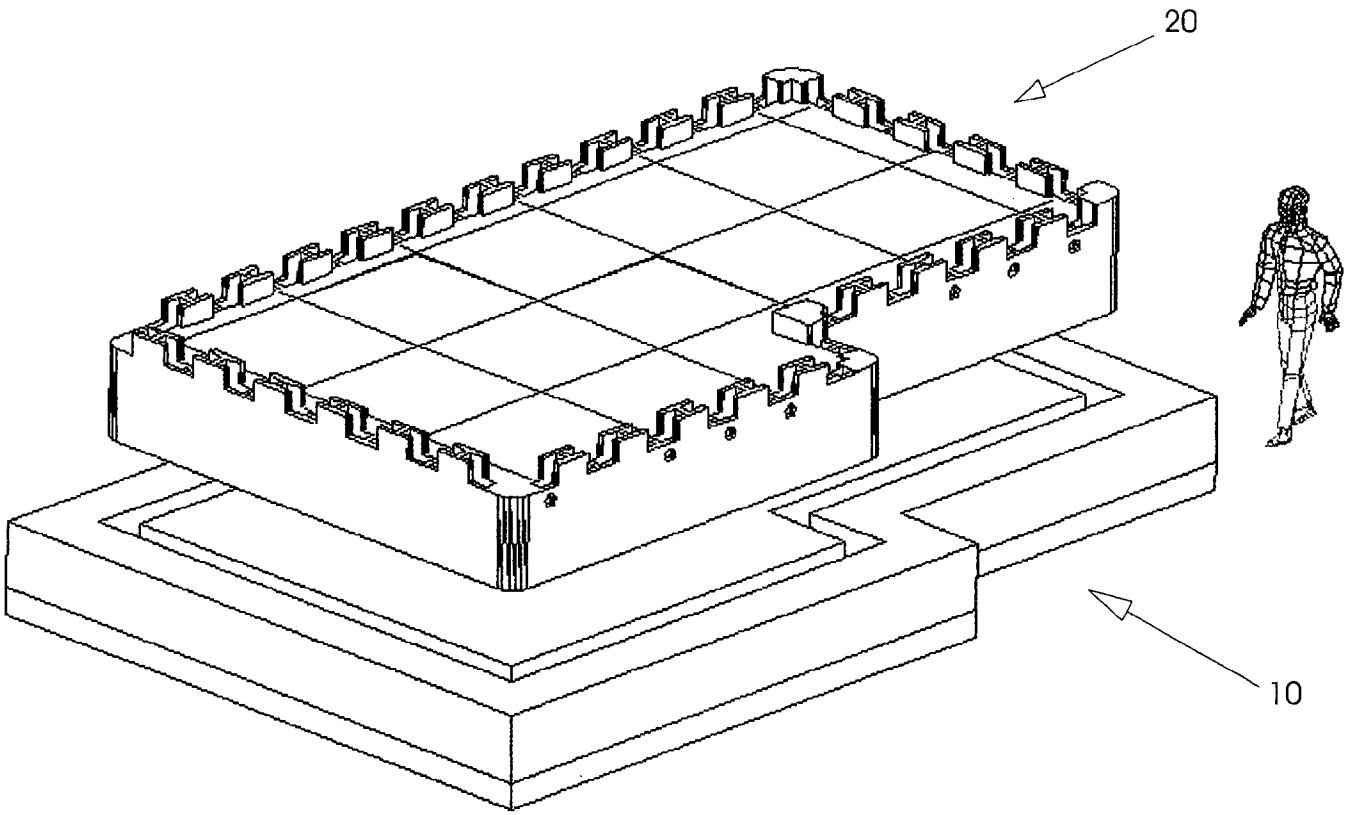
FIG. 24 is a perspective view of the first jig which is used to assemble the foam pieces forming the foundation with the foundation being lifted out of the jig with the floor side up.

FIG. 24 shows the foundation 20 being lifted out of jig 10.

Figure 25:
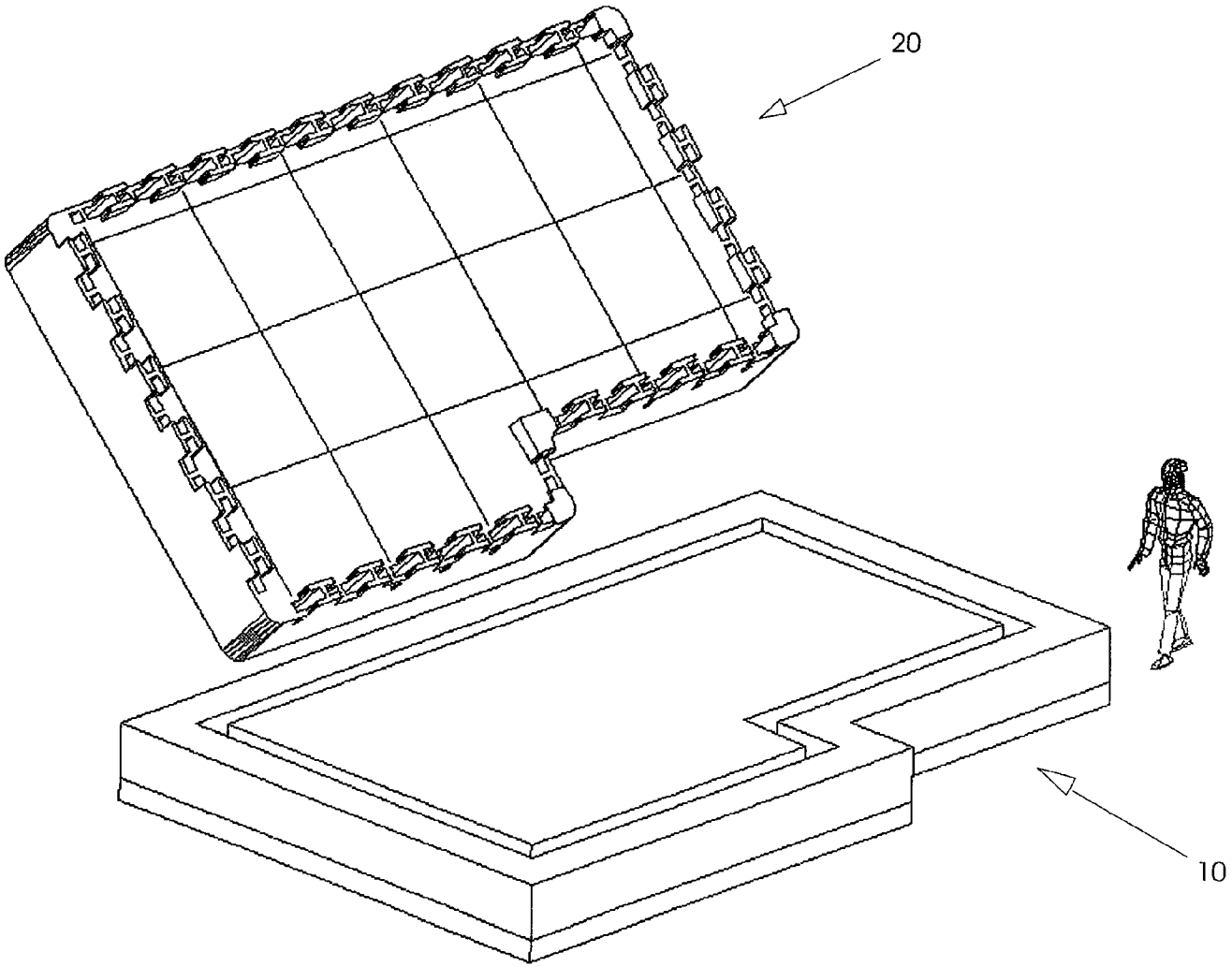
FIGS. 25 and 26 are perspective views of the first and second jig with the foundation being tilted to turn it over before being inserted in the second jig.
Figure 26:
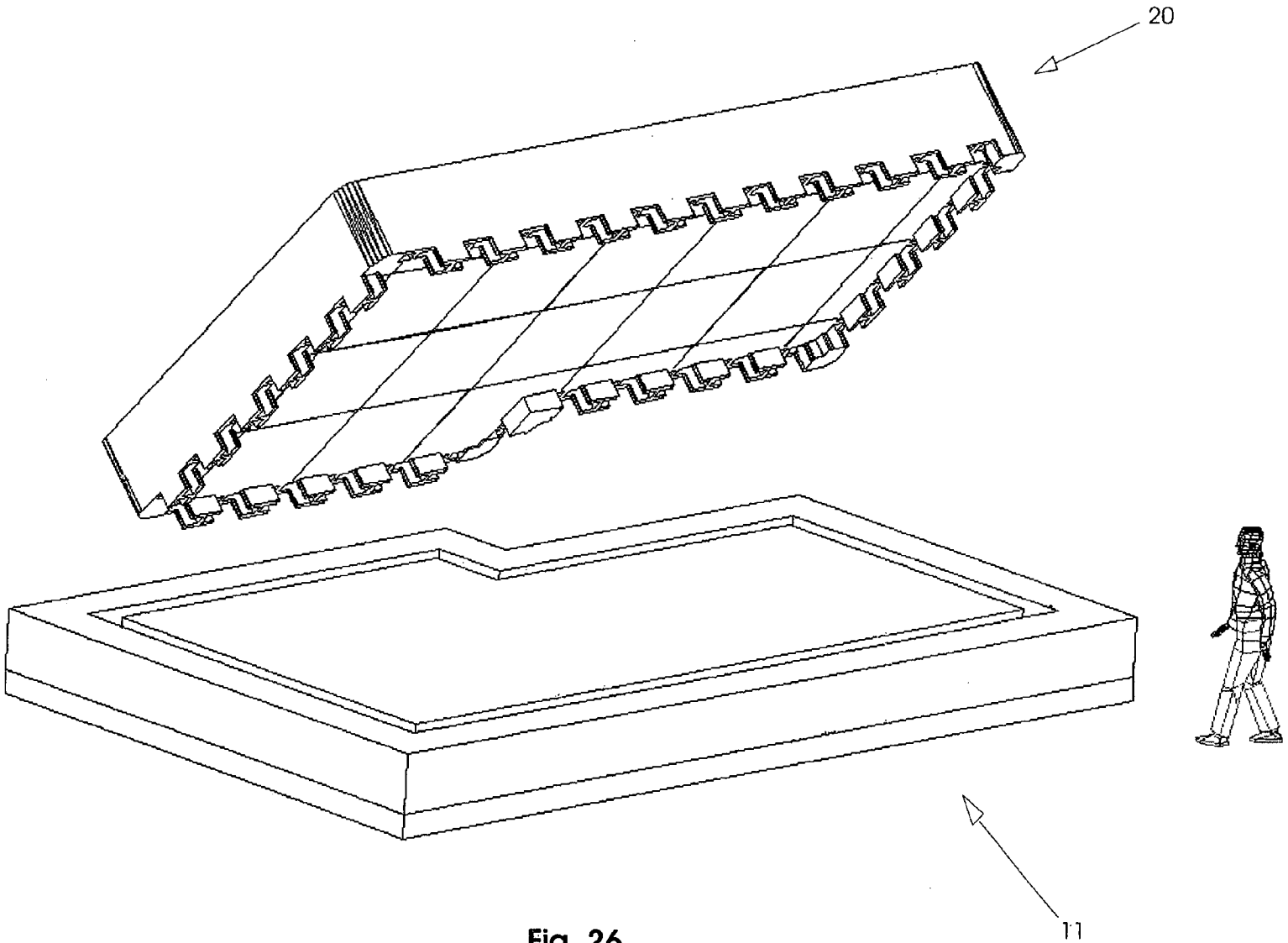

FIGS. 25 and 26 show the foundation 20 being turned over/flipped before being inserted in jig 11.

Figure 27:
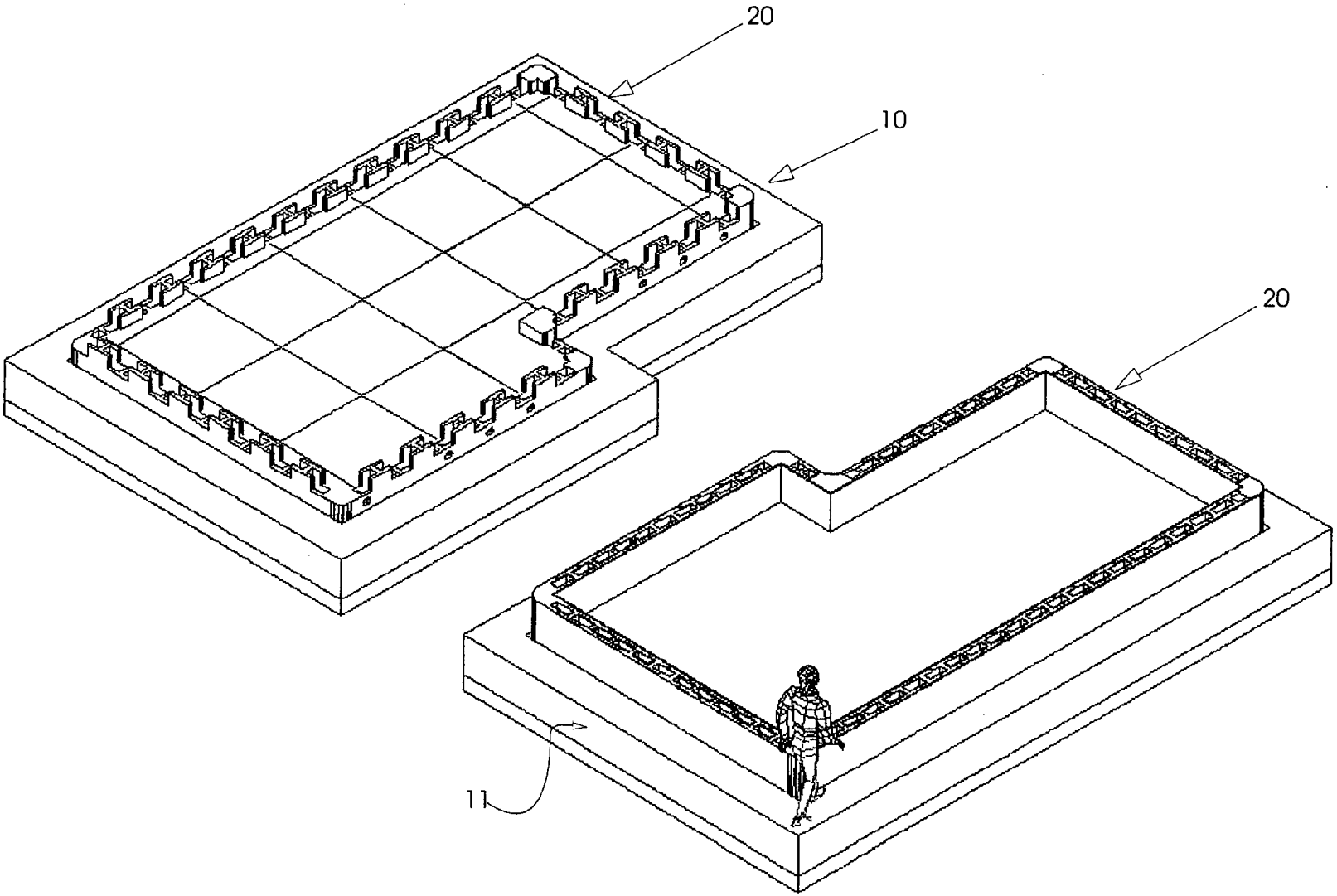
FIG. 27 is a perspective view of the second jig with the turned over foundation inserted into the jig and the underside being positioned for coating.

FIG. 27 shows the foundation 20 inserted in jig 11 and coated on its exposed surfaces with GFRC.

Figure 28:
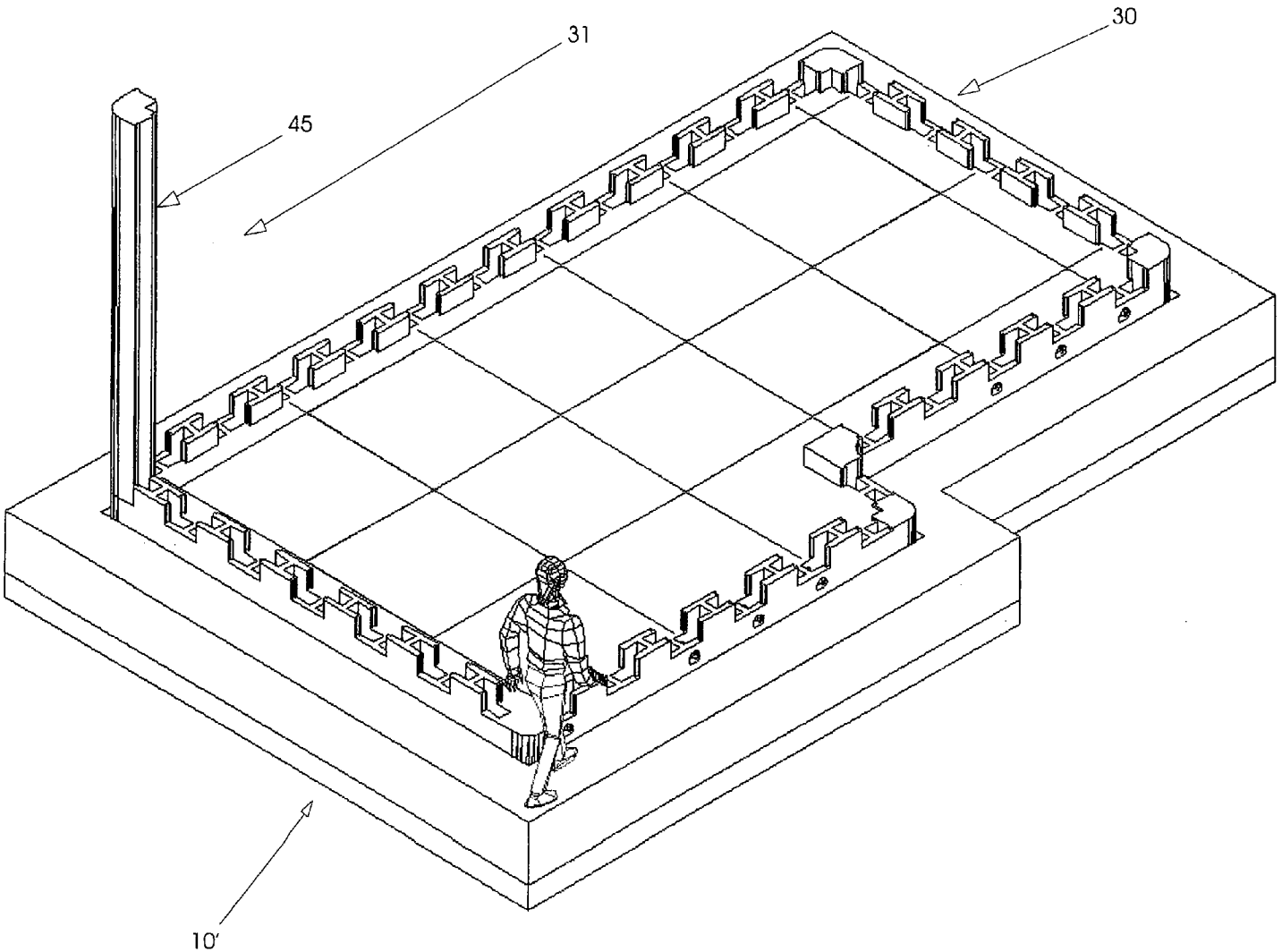
FIG. 28 is a perspective view of the third jig with the foundation turned over and inserted into the jig with the floor side up again and a corner foam piece inserted.

FIG. 28 shows the foundation again turned over or flipped and inserted in jig 10'. Once the foundation 20 has been turned over so that the topside of the foundation 20 (floor 60 and the first level 30 of side wall columns 40) is exposed, other columns 40 of the second level 31 are added by joining with a bonding agent.

Figure 29:
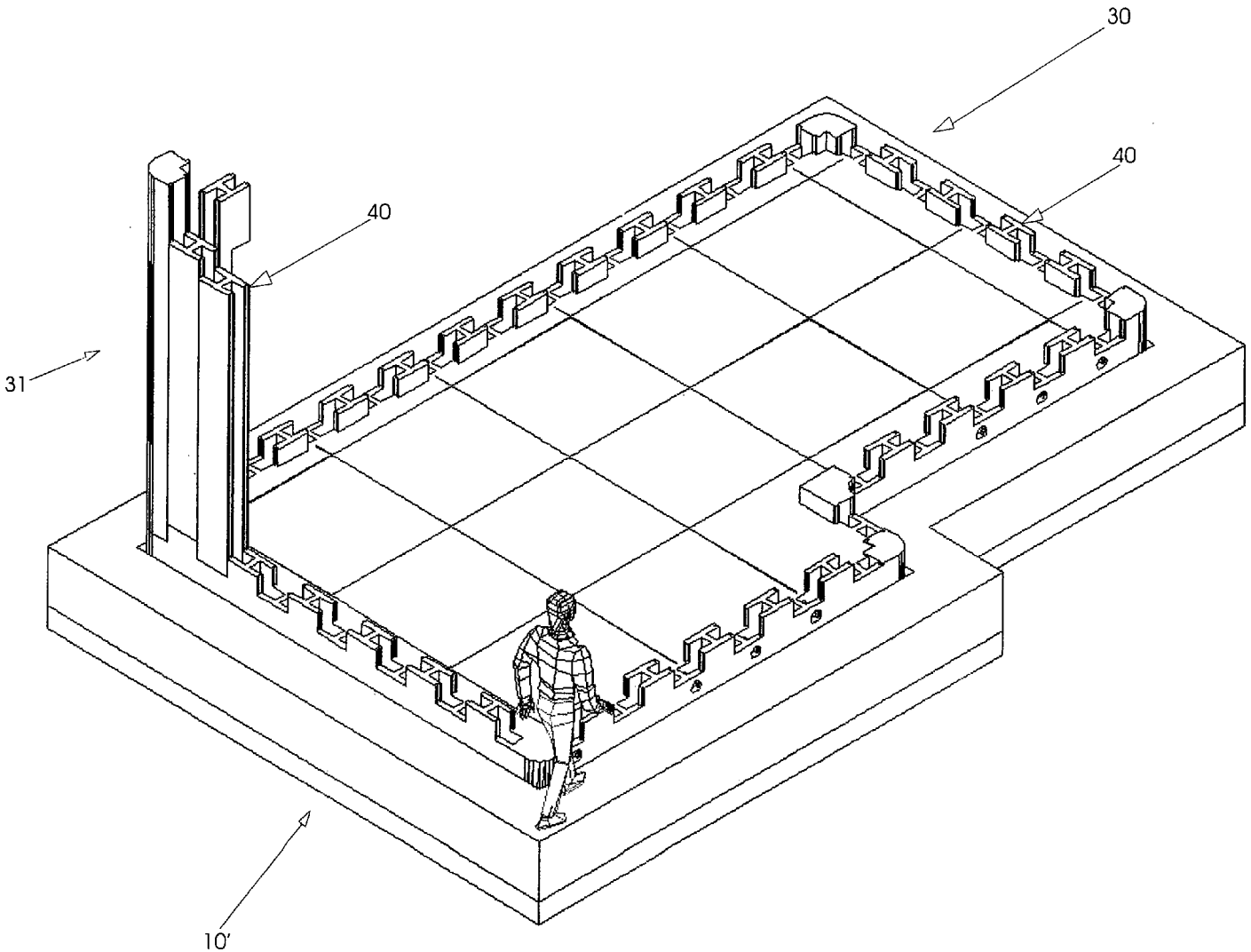
FIG. 29 is a perspective view of the addition of H columns to form the walls.
Figure 30:
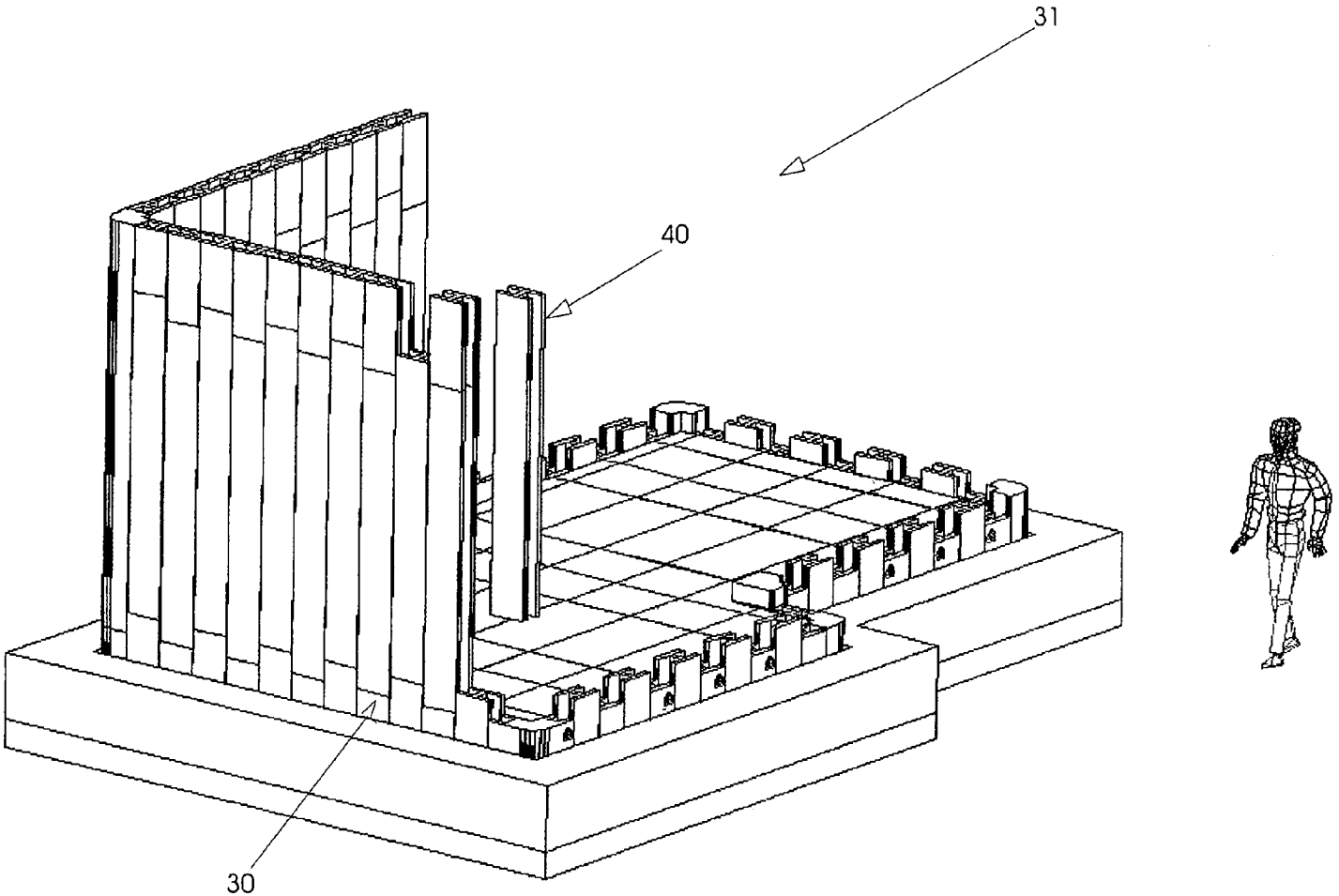
FIGS. 30 and 31 are perspective views of the addition of more H columns to form the walls.
Figure 31:
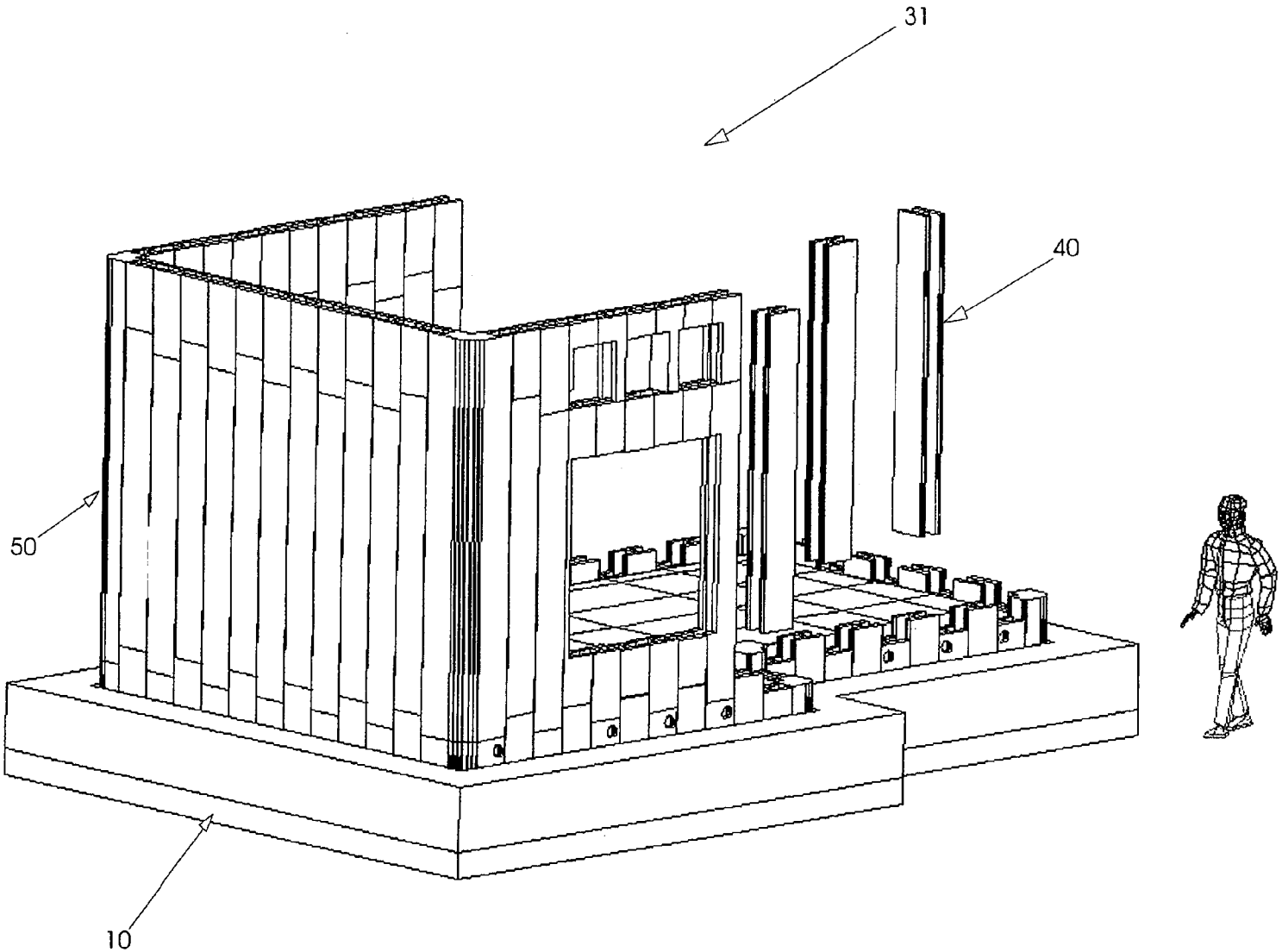

FIGS. 29-31 show more of the second level 31 of columns 40 being added.

Figure 32:
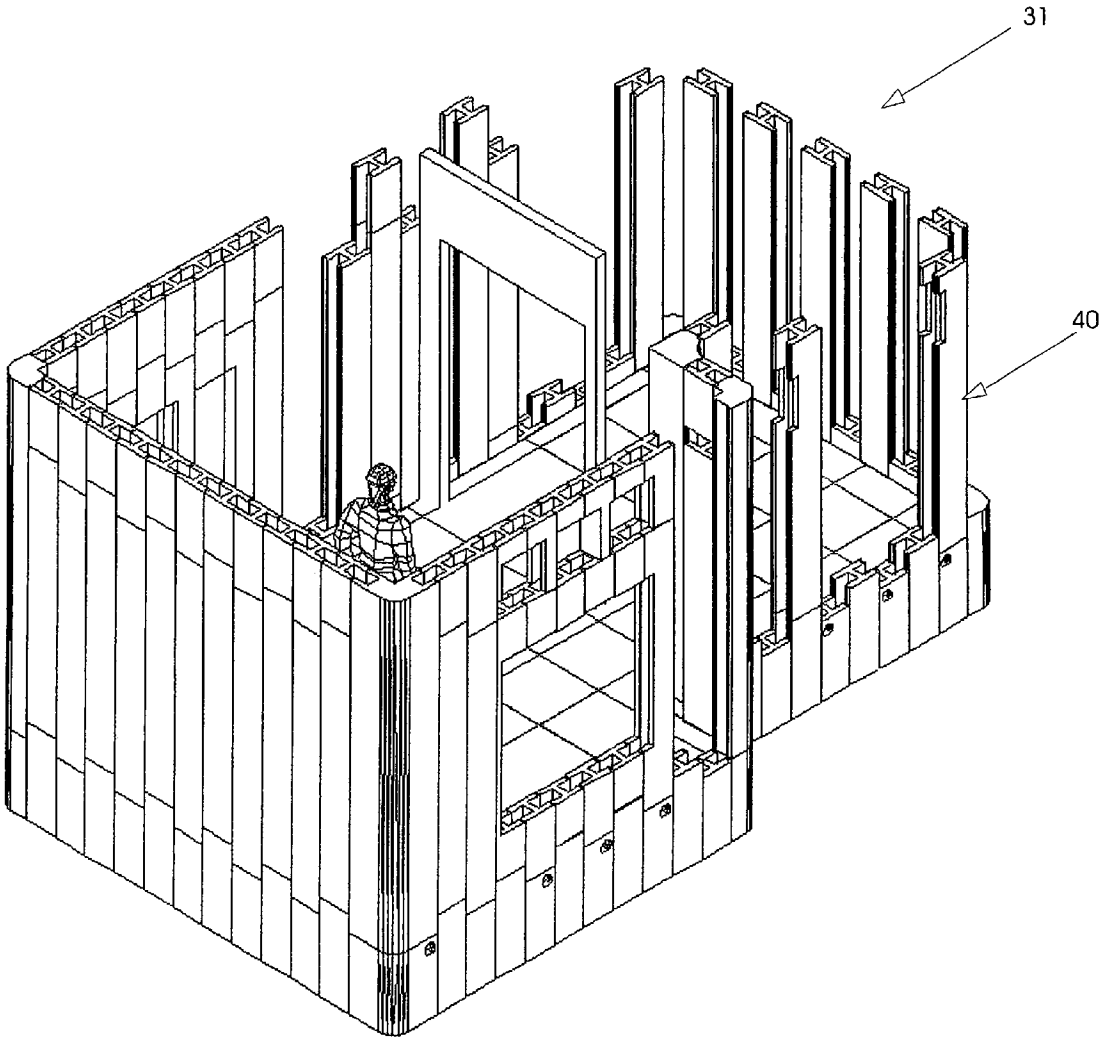
FIG. 32 is a perspective view of the addition of more H columns to form the walls and window openings.

FIG. 32 shows the addition of more columns some of which have cutout portions for receiving windows and doors. The walls can be put up without cut-outs for the windows and doors, and the holes for the windows and doors can be cut out later.

Figure 33:
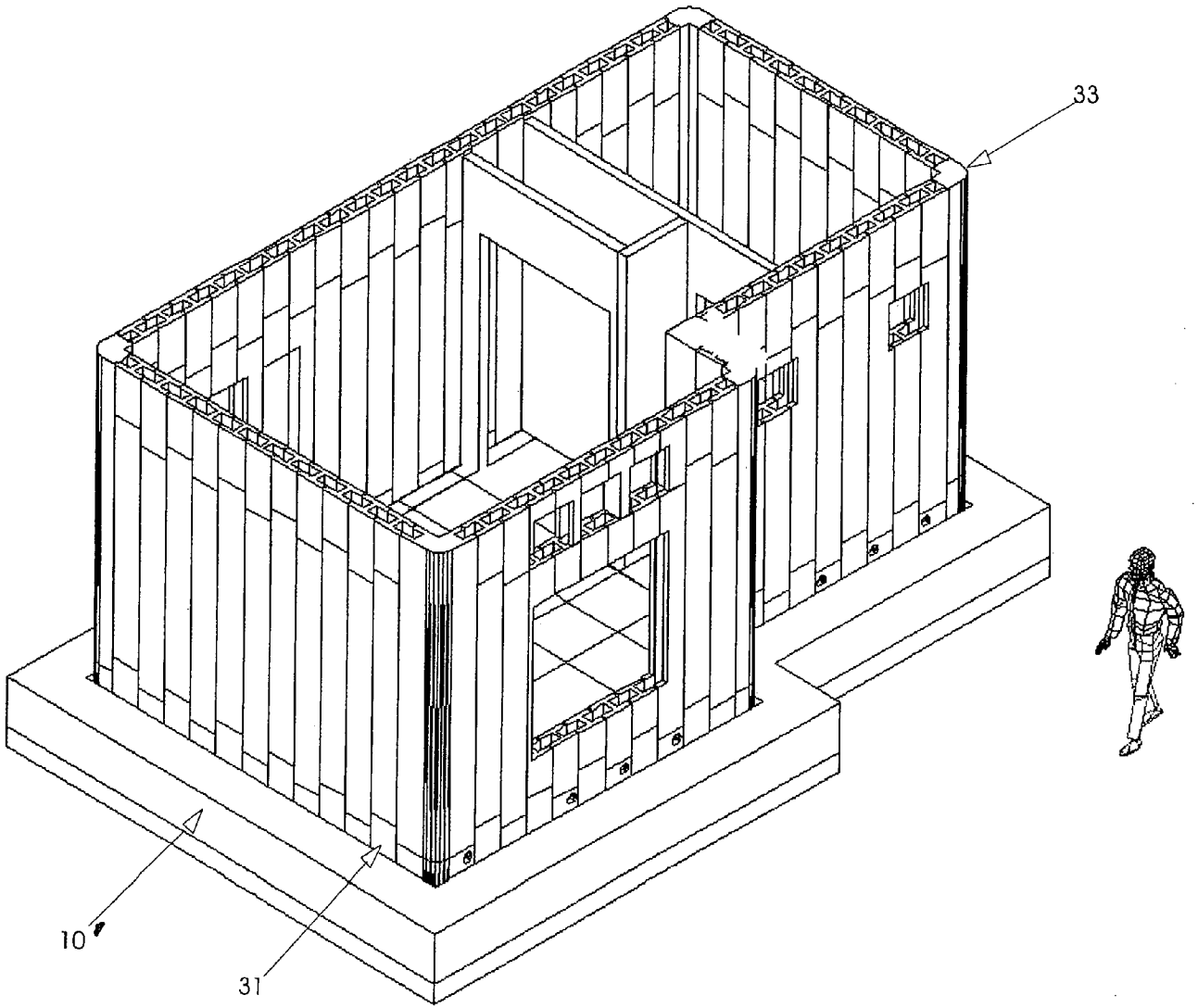
FIG. 33 is a perspective view of the building before the ceiling/roof beams are added.

FIG. 33 shows the finished first and second levels 31 and 32 of side wall columns with the corners of the third level 33 added.

Figure 34:
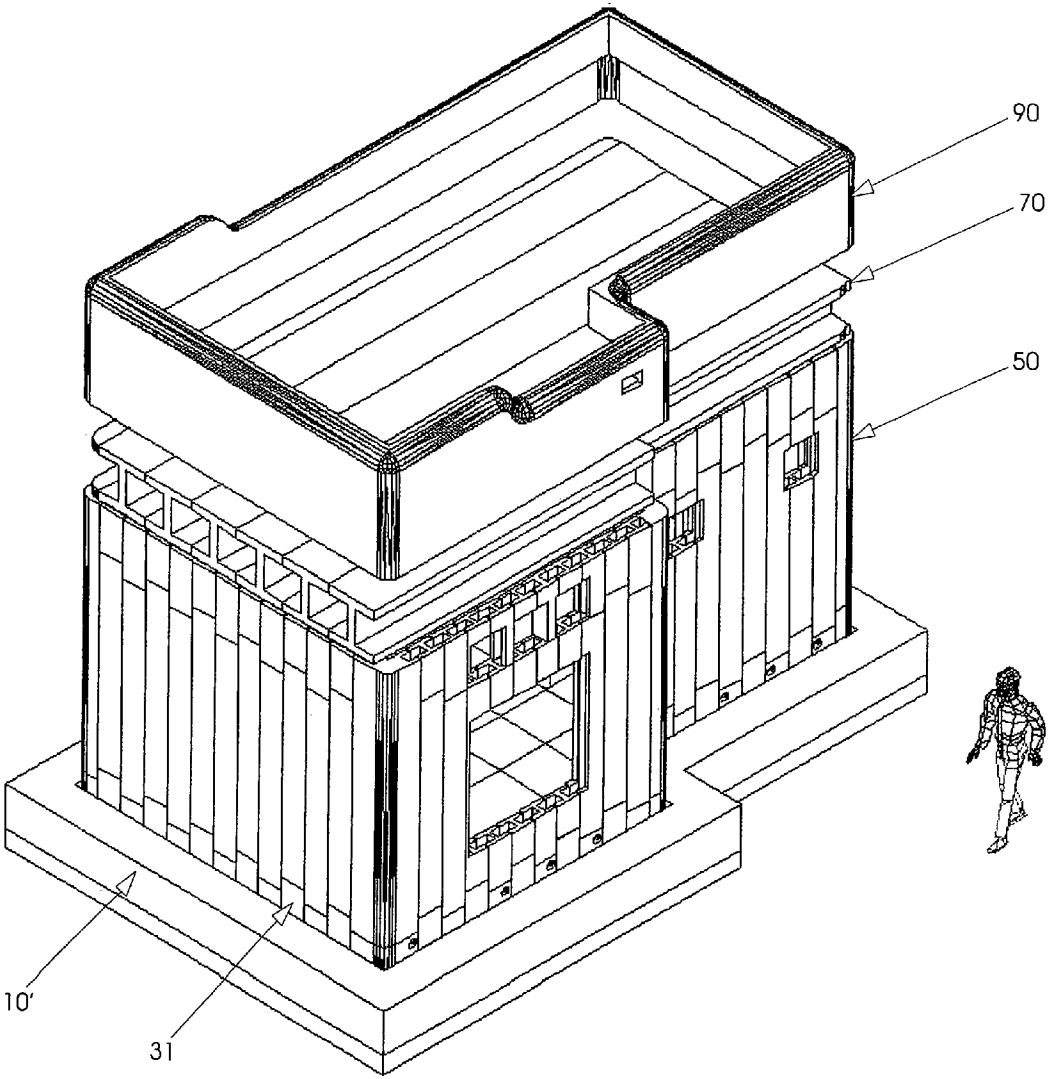
FIG. 34 is a perspective view of the building with the ceiling/roof beams without cover pieces added and the parapet wall about to be added.

FIG. 34 shows the finished side wall 50 and ceiling 70 with parapet wall 90 being added.

Figure 35:
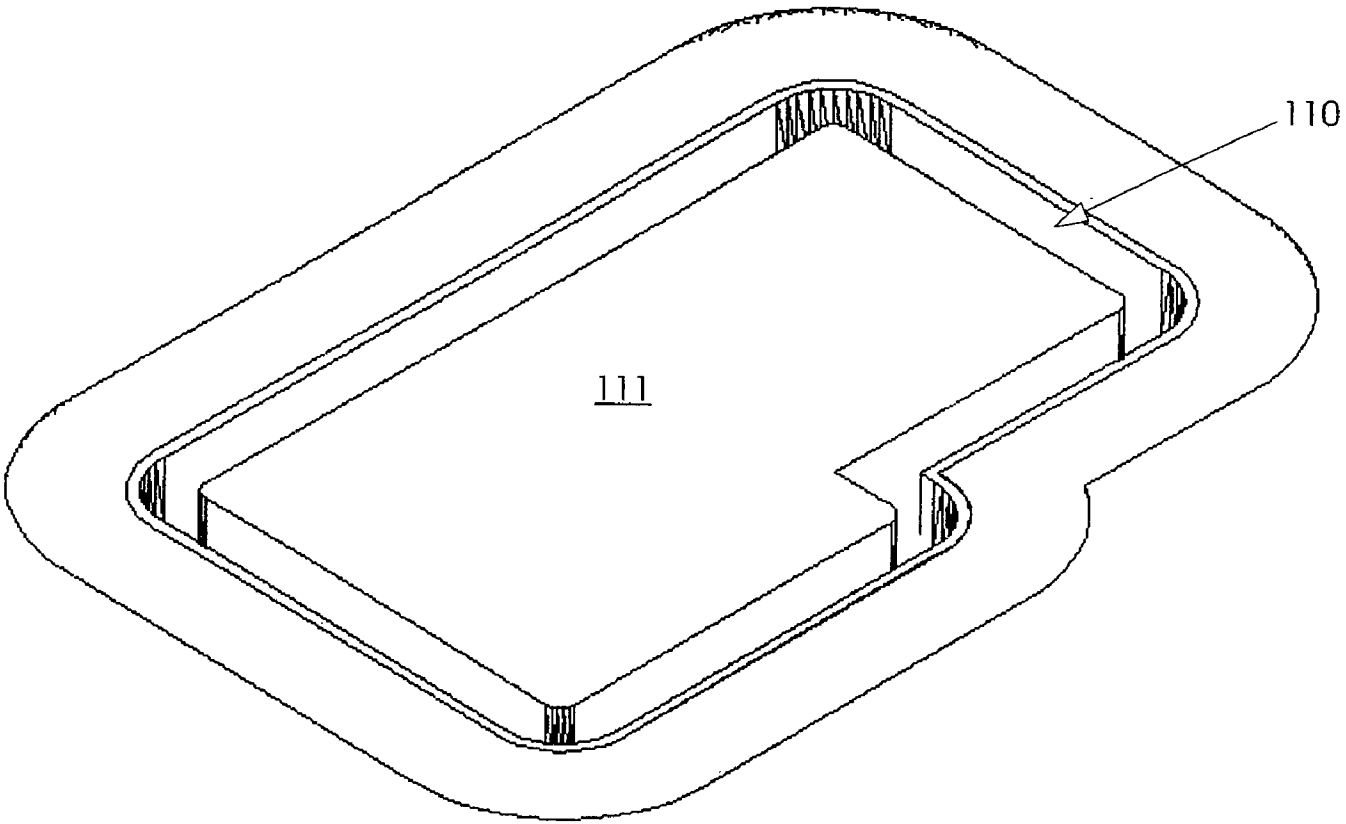
FIG. 35 is a perspective view of the building lot with the trench dug out to receive the foundation.

FIG. 35 shows the trench 110 and leveled lot 111 for the foundation. The stem wall formed by the first level of columns 30 does not extend to the bottom of the trench 110 so that concrete can be poured under the stem wall. The lower side of the floor 60 sits on and is supported by the leveled lot 111. The leveled lot would have gravel, such as ABC, as the top surface so that water can be drained away. The gravel can be drained to a lower area such as a storm drain. If the building is constructed on the leveled lot, the under side of the floor 60 does not have to be coated. If the building is constructed at another location and trucked to the lot, the under side of the floor 60 is coated with GFRC to increase its strength for handling and transport.

Figure 36:
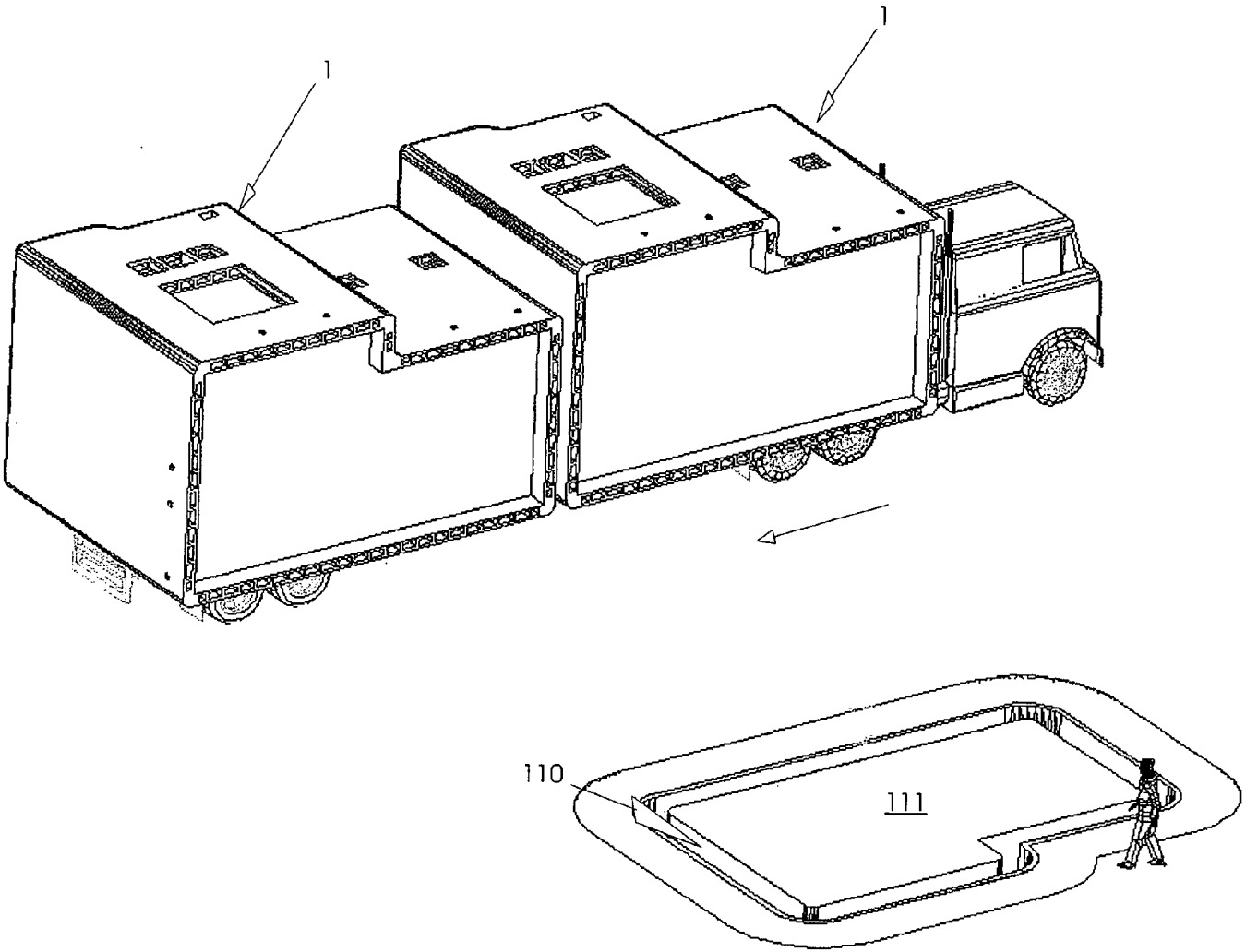
FIG. 36 is a perspective view of the manufactured building arriving at the lot on the truck from the factory.

FIG. 36 shows two buildings 1 arriving at the building lot by truck with the underside of the foundation facing the lot 111.

Figure 37:
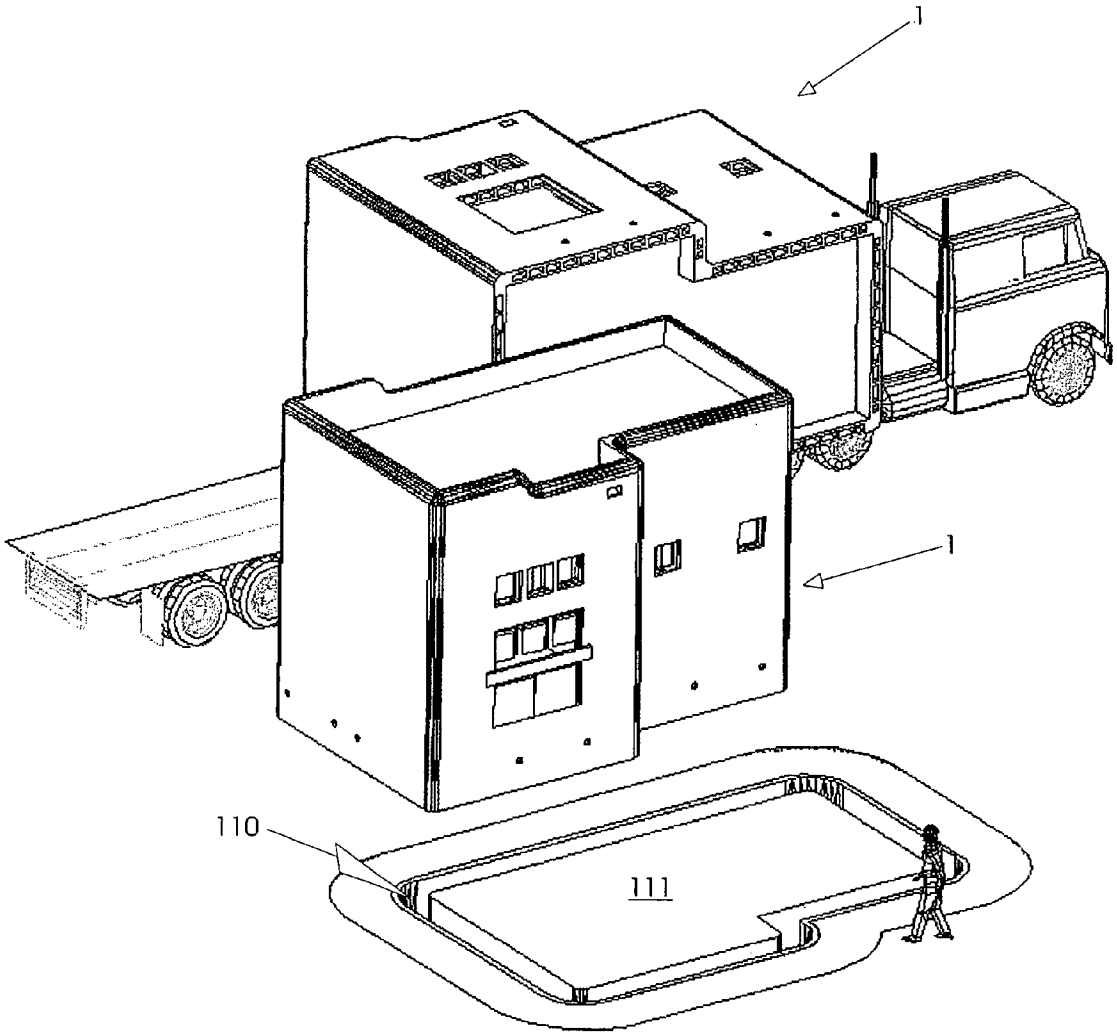
FIG. 37 is a perspective view of the manufactured building being off loaded from the truck.

FIG. 37 shows the building 1 being off-loaded and turned for insertion in the trench 110 which would be accomplished by heavy machinery.

Figure 38:
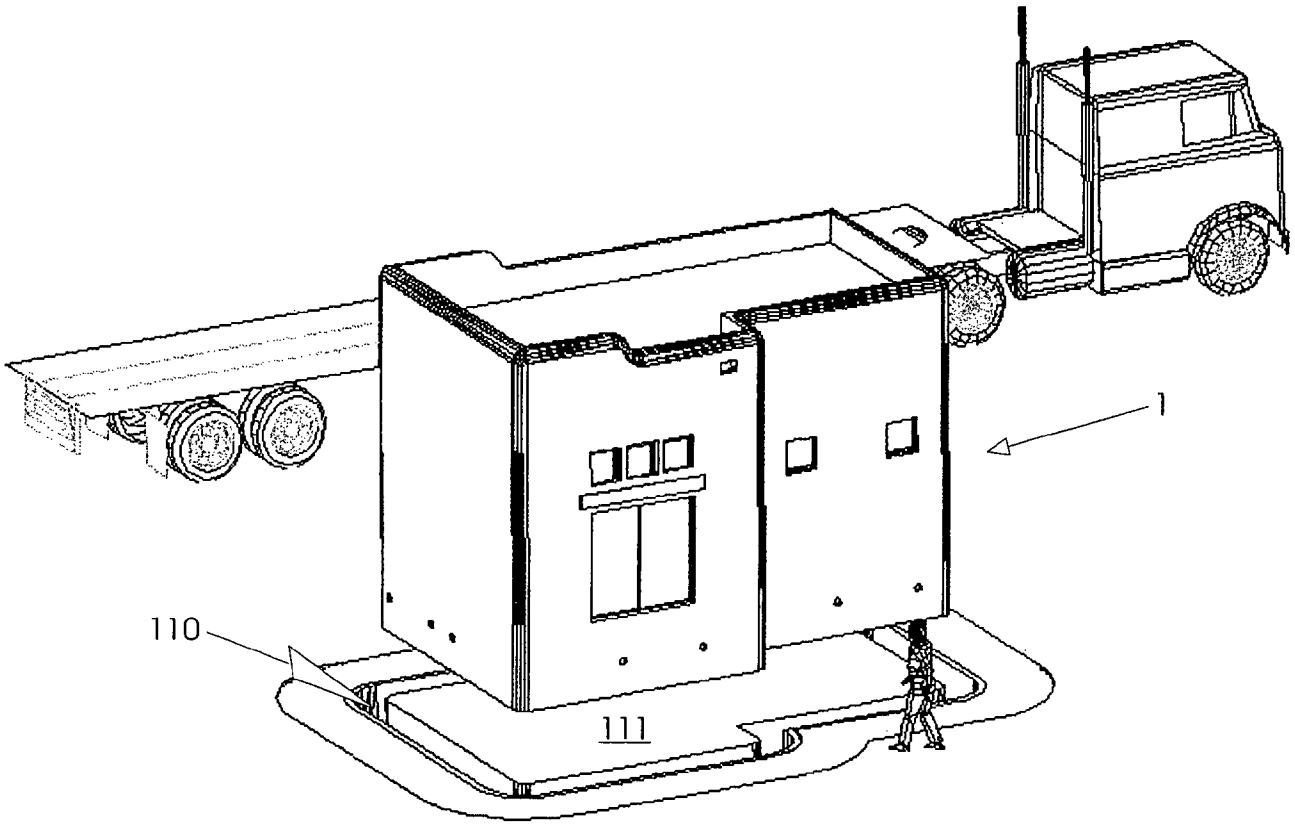
FIG. 38 is a perspective view of the manufactured building being aligned with the trench.

FIG. 38 shows the building 1 being positioned for insertion in the trench 110.

Figure 39:
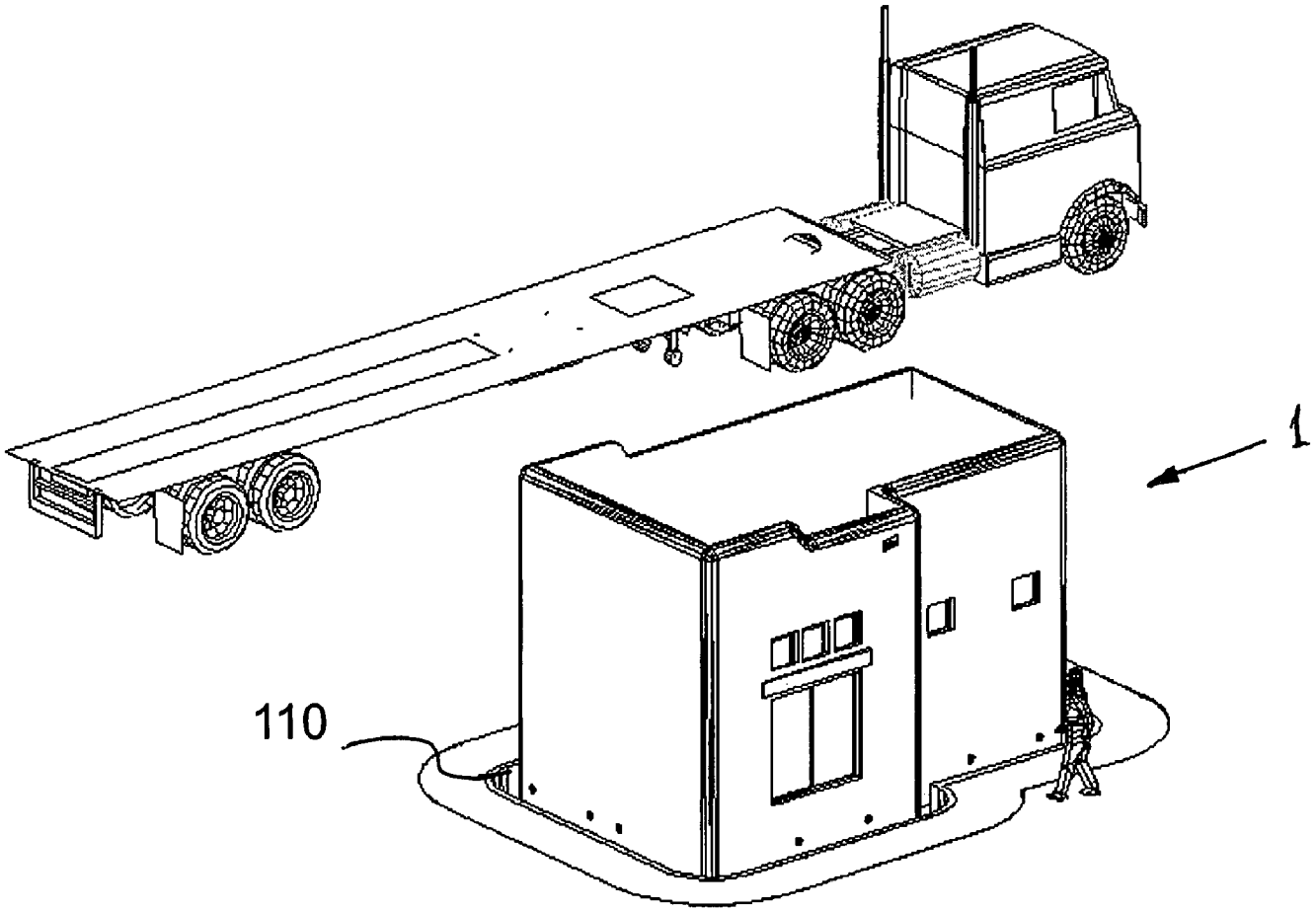
FIG. 39 is a perspective view of the manufactured building after being lowered into the trench.

FIG. 39 shows the building 1 resting in the trench 110.

Figure 40:
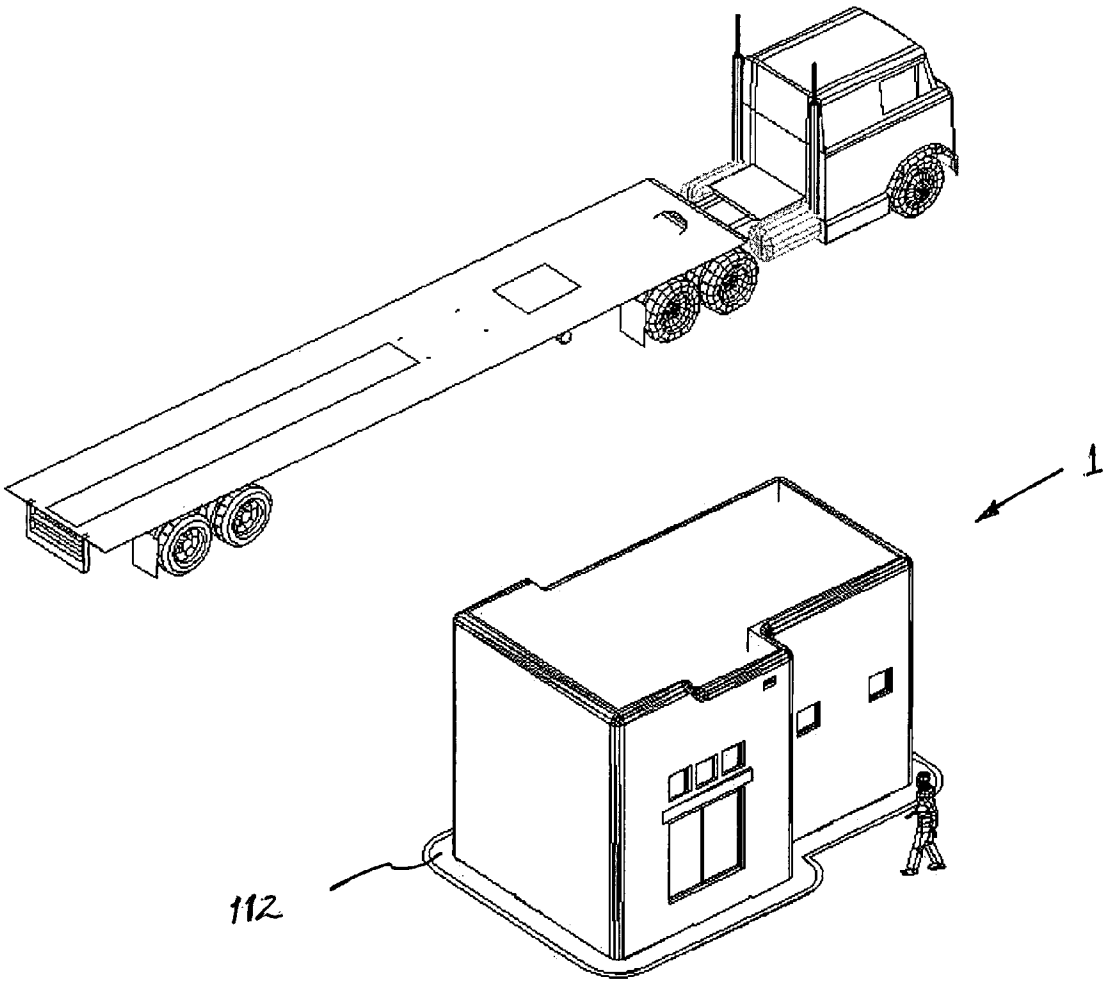
FIG. 40 is a perspective view of the manufactured building after having concrete poured into the trench and cured.

FIG. 40 shows the building 1 with a concrete apron 112 surrounding the foundation.

Figure 41:
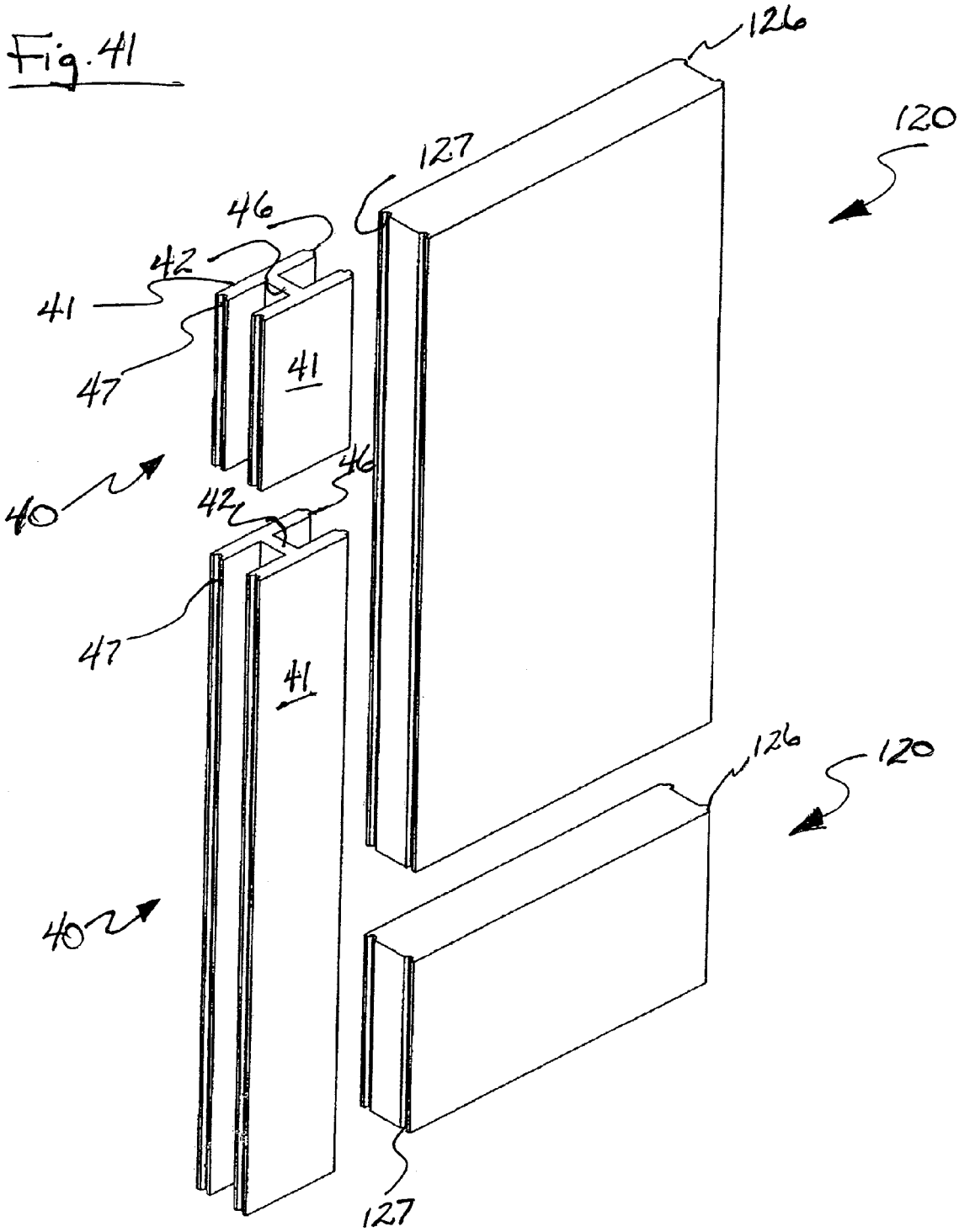
FIG. 41 is an exploded perspective view of a portion of a wall.
Figure 42:
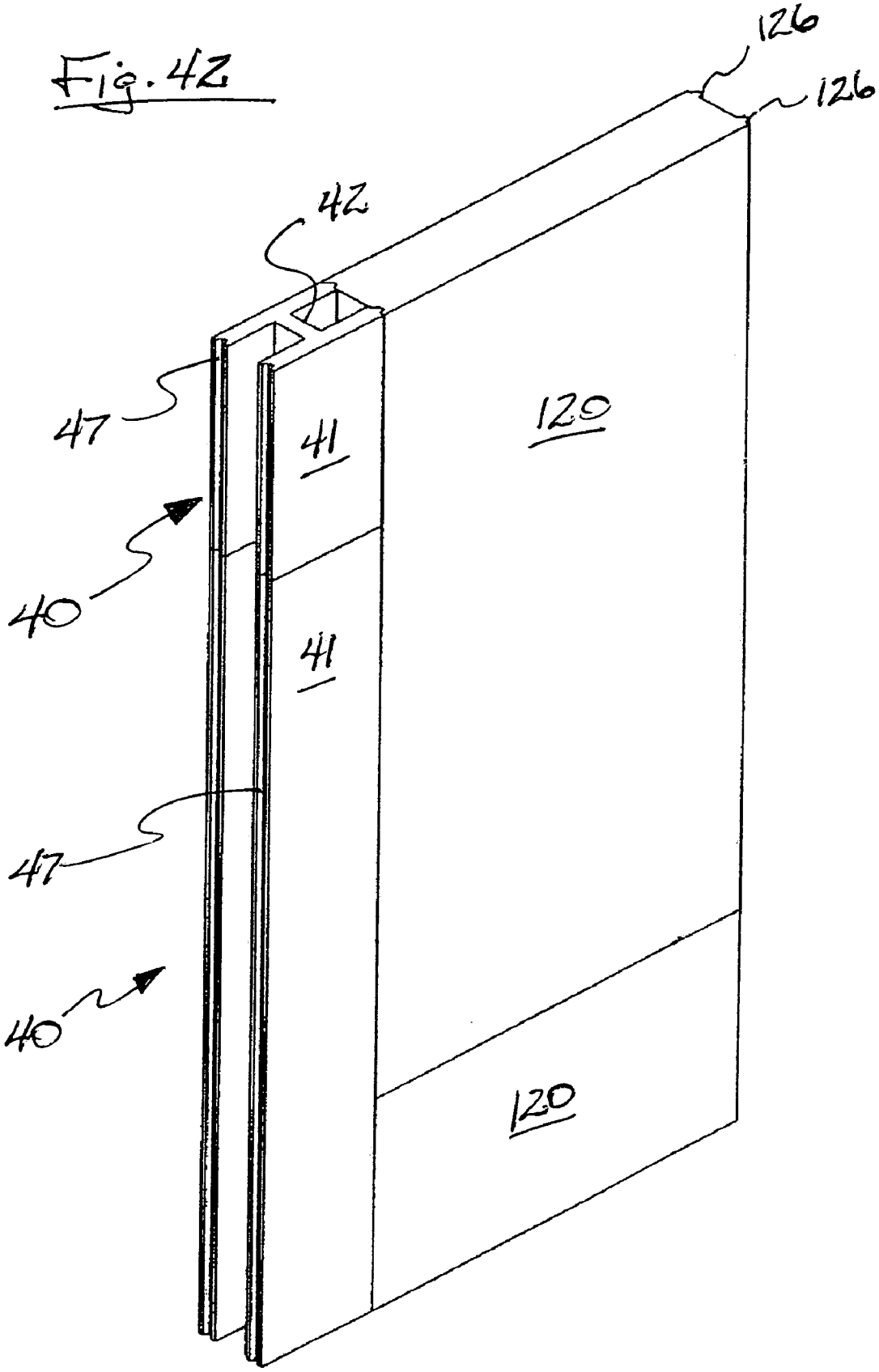
FIG. 42 is a perspective view of the assembled wall of FIG. 41.

FIGS. 41,42 show a portion of a wall that is built from H columns 40 and solid panel columns 120. The strongest building is formed from H column walls. However, H columns 40 are more costly to use than solid columns 120 formed from solid panels. H columns 40 can be interspersed with solid columns 120 to strengthen certain areas of a wall. On a wall that has a large number of windows or that extends for a great length without internal shear walls, H columns would be used liberally if not exclusively. The solid and H columns should have mating tongue 46, 126 and groove 47, 127 portions so that they fit together easily during assembly and interlock to increase their strength.

The walls can be coated with GFRC on either or both sides (exterior and interior) during construction to increase their strength against wind loads. The GFRC coating can be sprayed on the foam or applied in other ways. It can be reworked to provide a texture or design by an appropriate tool or smoothed by a roller until it sets. A coating of 3/16 inches thickness is usually adequate; however, a coating of varying thickness may be desirable. A suitable range for the coating can be 2/16 to 8/16 inches. More information concerning the GFRC coating and spray equipment can be obtained from the PRECAST/PRESTRESSED CONCRETE INSTITUTE OF Chicago, Ill. As an example of the proportions, the coating would be made by mixing 3-5% Cem-FIL™ fibers (glass fibers) from the VEROTEX COMPANY or Nippon Electric Company glass fibers from Japan into a 1:1, cement: sand and water matrix and other additives.

Beams or columns can have other shapes such as H, I, C, Z or other shape. The columns, beams or panels of plastic foam are coated with a bonding agent on the abutting edges before being placed into position and joined to the previously positioned column, beam or panel. For example, a suitable bonding agent would be either 3M™ FASTBOND™ Contact adhesive 30-NF or 2000-NF, 3M™ FASTBOND™ Foam Adhesive 100 or HILTI™ CF 128-DW POLYURETHANE INSULATING FOAM™. The bonding agent can be sprayed, rolled or applied to walls in numerous ways.

As an example of dimensions, the following are provided for a building that is to be constructed soon. The H columns are to be 8 or 10 inches deep with web 42 and flange 41 thickness of 2.5 or 3 inches and web 42 length of 3 or 4 inches. The flange 41 length or H column width is to be 12 to 24 inches. The solid panel columns are to be 8 or 10 inches thick to match the H columns with a width of up to 4 feet. The ceiling/roof beams (I-shaped) are to be 12 to 30 inches deep with flange 41 and web 42 thickness of 2 to 6 inches and web 42 length of 6 to 18 inches. The flange 41 length or beam width is to be 12 to 24 inches. The floor thickness is to be 4 to 8 inches. The GFRC coating is to be from ⅛ to ½ inches but mostly ¼ inches and can vary in different areas of the building. The specific dimensions will depend on the size, strength and height of building desired.

Extra insulation can be added to the columns or beams by adding any type of insulation to the spaces between the flanges, especially waste EPS (left-over "grinds") from the foam cutting operation.

Various changes and modifications to the embodiments herein chosen for purposes of illustration will readily occur to those skilled in the art. To the extent that such modifications and variations do not depart from the spirit of the invention, they are intended to be included within the scope thereof which is assessed only by a fair interpretation of the following claims.

I claim:

1. A method of building a composite building, the composite being plastic foam with fiber reinforced concrete coated on the exterior sides, the method comprising the following steps, forming a first beam of plastic foam having a web with opposed inner surfaces and legs with opposed inner and outer surfaces, coating the inner surfaces of the web and the legs with fiber reinforced concrete, forming a second beam of plastic foam having a web with opposed inner surfaces and legs with opposed inner and outer surfaces, coating the inner surfaces of the web and the legs with fiber reinforced concrete, then joining the first and second beams to each other along abutting edges with a bonding agent to form portions of the building, and then coating the outer surfaces of the legs of the joined beams with fiber reinforced concrete.

2. The method of claim 1 wherein, the building portion being at least a portion of a wall of the building.

3. The method of claim 1 wherein, the building portion being at least a portion of a ceiling of the building.

4. The method of claim 1 wherein, the building portion being at least a portion of a roof of the building.

5. A method of building a composite building, the composite being plastic foam with fiber reinforced concrete coated on the exterior sides, the method comprising the following steps, forming a first beam of plastic foam having a web with opposed inner surfaces and legs with opposed inner and outer surfaces, coating the inner surfaces of the web and the legs with fiber reinforced concrete, coating the outer surface of at least one of the legs with fiber reinforced concrete, forming a second beam of plastic foam having a web with opposed inner surfaces and legs with opposed inner and outer surfaces, coating the inner surfaces of the web and the legs with fiber reinforced concrete, coating the outer surface of at least one of the legs with fiber reinforced concrete, then joining the first and second beams to each other along abutting edges with a bonding agent to form portions of the building, and then coating the outer surfaces of the legs of the joined beams with fiber reinforced concrete.

6. The method of claim 5 wherein, the building portion being at least a portion of a wall of the building.

7. The method of claim 5 wherein, the building portion being at least a portion of a ceiling of the building.

8. The method of claim 5 wherein, the building portion being at least a portion of a roof of the building.

9. A method of building a composite building, the composite being plastic foam with fiber reinforced concrete coated on the exterior sides, the method comprising the following steps, forming a beam of plastic foam having a web with opposed inner surfaces and legs with opposed inner and outer surfaces, coating the inner surfaces of the web and the legs with fiber reinforced concrete, forming a solid column of plastic foam, then joining the beam and the column to each other along abutting edges with a bonding agent to form portions of the building, and then coating the outer surfaces of the joined beam and column with fiber reinforced concrete.

10. The method of claim 9 wherein, the building portion being at least a portion of a wall of the building.

11. The method of claim 9 wherein, the building portion being at least a portion of a ceiling of the building.

12. The method of claim 9 wherein, the building portion being at least a portion of a roof of the building.

13. A method of building a composite building, the composite being plastic foam with fiber reinforced concrete coated on the exterior sides, the method comprising the following steps, forming a beam of plastic foam having a web with opposed inner surfaces and legs with opposed inner and outer surfaces, coating the inner surfaces of the web and the legs with fiber reinforced concrete, coating the outer surface of at least one of the legs with fiber reinforced concrete, forming a solid column of plastic foam, then joining the beam and the column to each other along abutting edges with a bonding agent to form portions of the building, and then coating the outer surfaces of the joined beam and column with fiber reinforced concrete.

14. The method of claim 13 wherein, the building portion being at least a portion of a wall of the building.

15. The method of claim 13 wherein, the building portion being at least a portion of a ceiling of the building.

16. The method of claim 13 wherein, the building portion being at least a portion of a roof of the building.

* * * * *